US010703529B2

(12) United States Patent
Goretti

(10) Patent No.: US 10,703,529 B2
(45) Date of Patent: Jul. 7, 2020

(54) PARTITION AND COVER STRUCTURE THAT CAN BE ACCOMMODATED IN A SHOEBOX, SHOEBOX INCLUDING SAID STRUCTURE AND FOLDABLE ELEMENT FOR OBTAINING SAID STRUCTURE

(71) Applicant: Assograph Italia S.r.l., Cesano Maderno (MB) (IT)

(72) Inventor: Franco Goretti, Cesano Maderno (MB) (IT)

(73) Assignee: ASSOGRAPH ITALIA S.R.L., Cesano Maderno (MB) (IT)

( * ) Notice: Subject to any disclaimer, the term of this patent is extended or adjusted under 35 U.S.C. 154(b) by 0 days.

(21) Appl. No.: 16/273,422

(22) Filed: Feb. 12, 2019

(65) Prior Publication Data

US 2019/0248538 A1 Aug. 15, 2019

(30) Foreign Application Priority Data

Feb. 13, 2018 (IT) ..... 102018000002643

(51) Int. Cl.
*B65D 5/4805* (2006.01)
*B65D 85/18* (2006.01)
(Continued)

(52) U.S. Cl.
CPC ..... *B65D 5/48022* (2013.01); *B65D 5/48042* (2013.01); *B65D 5/48048* (2013.01); *B65D 85/187* (2013.01)

(58) Field of Classification Search
CPC ..... B65D 5/48022; B65D 5/48034; B65D 5/48032; B65D 5/5002–5016; B65D 85/187
(Continued)

(56) References Cited

U.S. PATENT DOCUMENTS 2,747,785 A * 5/1956 Fink ..... B65D 5/48008 229/117.14
4,202,465 A * 5/1980 McLaren ..... B65D 5/48022 220/23.83
(Continued)

FOREIGN PATENT DOCUMENTS

CA 2826011 A1 * 8/2012 ..... B65D 5/48022
FR 1 539 148 9/1968
(Continued)

OTHER PUBLICATIONS

Italian Search Report, IT 2018000002643, dated Sep. 13, 2018.
Written Opinion, IT2018000002643, dated Feb. 13, 2018.

*Primary Examiner* — Nathan J Newhouse
*Assistant Examiner* — Phillip D Schmidt
(74) *Attorney, Agent, or Firm* — Young & Thompson

(57) ABSTRACT

Disclosed is a partition and cover structure that can be accommodated in a shoebox and can be made from one or more conveniently grooved and cut cardboard sheets. The structure includes a substantially rectangular base divided into first and second portions having trapezoidal rectangular shape. The portions of base are consecutive to each other at a respective edge coincident with the oblique side of the aforesaid trapezoidal shape. A pair of mutually opposed partition walls are connected, by way of a fold, to the portions of base at the aforesaid edges, respectively. The structure further includes four side walls two-by-two mutually opposite with respect to the portions of base and connected to the latter by way of respective folds. Also disclosed is a shoebox including the structure, and to one or more substantially flat elements foldable in suitable manner to obtain such structure.

12 Claims, 16 Drawing Sheets

(51) Int. Cl.
*B65D 5/498* (2006.01)
*B65D 5/49* (2006.01)

(58) Field of Classification Search
USPC .... 229/120.17, 120.01, 120.37–120.38, 171, 229/198.2, 930, 120.08–120.21
See application file for complete search history.

(56) References Cited

U.S. PATENT DOCUMENTS

| | | | | | |
|---|---|---|---|---|---|
| 5,056,709 | A * | 10/1991 | Cargile, Jr. ..... | B65D 5/48022 | 229/120.12 |
| 5,060,802 | A | 10/1991 | Johnson et al. | | |
| 6,189,777 | B1 * | 2/2001 | Hutchinson ..... | B65D 77/042 | 229/120.37 |
| 2004/0211822 | A1 * | 10/2004 | Lin ..... | B65D 5/22 | 229/120.12 |

FOREIGN PATENT DOCUMENTS

| | | |
|---|---|---|
| GB | 2 525 599 | 11/2015 |
| NL | 1 022 099 | 6/2004 |

* cited by examiner

PARTITION AND COVER STRUCTURE THAT CAN BE ACCOMMODATED IN A SHOEBOX, SHOEBOX INCLUDING SAID STRUCTURE AND FOLDABLE ELEMENT FOR OBTAINING SAID STRUCTURE

FIELD OF APPLICATION OF THE INVENTION

The present invention applies to the field of boxes suitable for containing a pair of shoes, boots or similar footwear, i.e. footwear usually sold in pairs accommodated in respective boxes. For convenience of disclosure, the term "shoes" in the description below refers to any pair of footwear of the aforesaid type.

Namely, the present invention relates to a partition and cover structure that can be accommodated in a box suitable for containing a pair of shoes in order to prevent contact therebetween. The present invention also relates to a shoebox including the aforesaid structure and to one or more substantially flat elements foldable in a suitable manner to obtain said structure.

OVERVIEW OF THE PRIOR ART

As known, shoeboxes generally comprise a parallelepiped rectangular container without the upper base. Namely, the container comprises a usually rectangular lower base and four side walls, they also rectangular, connected to the lower base at the edges thereof, respectively. The side walls delimit an opening (coincident with the upper base of the parallelepiped) to allow the introduction of a pair of shoes into the container. Said opening may be closed by means of a substantially rectangular lid which may be rested on the side walls at the upper edges thereof.

Given that the volume of a shoe may be schematized as a prism having a trapezoidal rectangular base, a pair of shoes usually is accommodated in a box in such a manner whereby the soles are mutually parallel and the uppers are mutually opposed. Namely, when a pair of shoes is accommodated in a box, each shoe rests on the lower base of the container at a side portion of the upper, and is arranged with the sole opposed to a side wall of the container. The shoes of a same pair rest on the lower base of the container at opposite side portions of the respective uppers so that the toe of one shoe is opposed to the opening of the other shoe. Unfortunately, when accommodated in a box, said arrangement results in the shoes of a same pair coming into contact with each other at the portion of upper that covers the instep of a foot when the shoe is worn by a person. The contact between the uppers may result in a rubbing during the transport of the box or more generally, during the movement thereof. If repeated, said rubbing between the uppers may irreparably damage the shoes.

In order to avoid a contact between the two shoes (of the same pair) accommodated in a box, the shoes are usually wrapped in a protective material, such as for example one or more layers of tissue paper. The at least partial covering of each shoe with said protective material is however an operation which generally is performed manually, with subsequent lengthening of the shoe packaging times.

OBJECTS OF THE INVENTION

It is the object of the present invention to overcome the aforesaid drawbacks by indicating a partition structure which may be placed in a shoebox and suitable for preventing a contact between two shoes (same pair) accommodated therein so as to avoid the same from requiring being at least partly covered with a protective material.

SUMMARY OF THE INVENTION

The object of the present invention is a partition and cover structure that can be accommodated in a shoebox and can be made from one or more substantially flat elements foldable on themselves. Whether or not it is one or more, the starting flat element preferably, but not necessarily, is a cardboard sheet with suitable groovings, more preferably a corrugated cardboard sheet, and even more preferably a microwave corrugated cardboard sheet.

The structure of the invention comprises:

- a base divided into a first and a second portion;
- a first partition wall including a first and second mutually opposite edge, said first partition wall being connected by means of a fold, at at least one stretch of the first edge thereof, to at least one stretch of a first edge of said first portion of the base;
- a second partition wall including a first and second mutually opposite edges, said second partition wall being connected by means of a fold, at at least one stretch of the first edge thereof, to at least one stretch of a first edge of said second portion of the base;
- said partition walls being opposable to each other in such a manner whereby when said partition walls are opposed to each other, said first and second portions of the base are substantially consecutive to each other at the respective first edge thereof;
- a first, a second, a third and a fourth side walls, two-by-two mutually opposite with respect to said base,
- at least one of said side walls being connected to said first or second portion of the base by means of at least one fold,
- each of said side walls being connected to said first or second portion of the base or to another of said side walls, by means of at least one fold.

The structure of the invention can be accommodated in a shoebox by opposing the two partition walls in such a manner whereby the portions of the base are consecutive to each other at the respective first edge, and by resting the base of the structure against the base of the box in such a manner whereby the side walls of the structure are opposed to the side walls of the box, respectively. When the structure of the invention is accommodated in a shoebox, the structure divides the inside of the box into two compartments separated from each other by the pair of partition walls. Two shoes belonging to the same pair can thus advantageously be accommodated in different compartments of the same box so that contact may not occur therebetween. Incidentally, each shoe can preferably be accommodated in one of the two compartments in such a manner whereby the portion of upper covering the instep of a foot when the shoe is worn by a person is opposed to one of the partition walls.

When accommodated in a shoebox, in addition to performing a partitioning function, the structure of the invention serves as lining since it internally and at least partly lines the box, covering the base and the side walls of the latter. The structure of the invention thus also performs a protective function with regards to a pair of shoes accommodated in a box, thus forming a second packaging thereof.

Other innovative features of the present invention are illustrated in the following description and are referred to in the dependent claims.

According to one aspect of the invention, said second partition wall is connected by means of at least one fold to the second edge of said first partition wall at the second edge thereof.

Advantageously, as is better disclosed later in the present description, if the partition walls are connected to each other by at least one fold, the structure of the invention may be made from a single flat element foldable on itself.

According to this aspect of the invention, in order to oppose the two partition walls in such a manner whereby the portions of the base are consecutive to each other at the respective first edge, it is sufficient to fold the partition walls one with respect to the other about the respective second edges.

According to another aspect of the invention, said first and second portions of the base are shaped in such a manner whereby when said first and second portions of the base are substantially consecutive to each other at the respective first edge thereof, said base substantially is square- or rectangular-shaped, given that the first edge of said first and second portion is tilted (that is not parallel) with respect to each of the four edges of said base corresponding to the four sides of said square or rectangular shape thereof.

According to this aspect of the invention, the first and the second portions of the base are for example, trapezoidal rectangular in shape, with the first edge corresponding to the side of the trapezoidal shape tilted with respect to the largest base and to the smallest base thereof.

Advantageously, each compartment into which the structure of the invention divides a shoebox is shaped as a prism having a trapezoidal rectangular base, i.e. as the three-dimensional shape in which the volume of a shoe generally may be schematized.

According to another aspect of the invention:

- the first edge of said first partition wall is separate from the first edge of said first portion of the base at two mutually opposite end stretches so that said first partition wall is foldable along two lines arranged transversely to said first portion of the base when said partition walls are opposed to each other;
- the first edge of said second partition wall is separate from the first edge of said second portion of the base at two mutually opposite end stretches so that said second partition wall is foldable along two lines arranged transversely to said second portion of the base when said partition walls are opposed to each other.

Advantageously, according to this aspect of the invention, the dimensions of the two compartments separated by the partition walls may be adapted to the height of the heel of the pair of shoes to be accommodated therein.

According to another aspect of the invention:

- said first partition wall comprises a first cut which extends from the first to the second edge of said first partition wall, from an end of one of said two end stretches (of the first edge of said first partition wall);
- said second partition wall comprises a second cut which extends from the first to the second edge of said second partition wall, from an end of the end stretch (of the first edge of said second partition wall) not opposed to the end stretch from which end said first cut starts when said first and second portions of the base substantially are consecutive to each other at the respective first edge thereof.

Advantageously, when the partition walls are opposed to each other, the cut in a partition wall facilitates the folding of the other partition wall along a line opposed to said cut.

According to another aspect of the invention, the structure further comprises a lid connected to at least one of said side walls by means of a fold.

According to another aspect of the invention, said portions of the base, said partition walls, said side walls and, when present, said lid, are at least partly covered with at least a material selected in the group including fabric, non-woven fabric, paint and polymeric materials.

According to this aspect of the invention, the structure is at least partly covered with fabric and/or non-woven fabric and/or preferably non-scratch paints and/or polymeric materials (such as e.g. polyethylene) at the "inner" faces of the walls forming it, i.e. the faces facing the shoes possibly accommodated in the compartments delimited by said structure.

The covering advantageously protects the shoes from any rubbing therebetween and the walls of the structure of the invention.

According to another aspect of the invention:

- said first side wall is connected by means of a fold, to said first portion of the base at a second edge thereof opposite to said first edge (of said first portion of the base);
- said second side wall is connected by means of a fold, to said second portion of the base at a second edge thereof opposite to said first edge (of said second portion of the base);
- said third side wall is connected by means of a fold, to said first or second portion of the base at a third edge thereof interposed between said first and second edge (of said first or second portion of the base);
- said fourth side wall is connected by means of a fold, to said first or second portion of the base at a further edge thereof interposed between said first and second edge (of said first or second portion of the base).

Another object of the invention is a container comprising:

- a shoebox including:
  - a square or rectangular base;
  - four side walls connected transversely to said base at respective edges thereof and delimiting, together with said base, a seat in which a pair of shoes can be accommodated;
- the structure of the invention, accommodated in said seat,
- said partition walls of the structure of the invention being mutually opposed, said first and second portion of the base of the structure of the invention being substantially consecutive to each other at the respective first edge thereof,
- said first and second portion of the base of the structure of the invention being shaped in such a manner whereby the base of said structure substantially is square- or rectangular-shaped and substantially has the same extension as the base of said box,
- said first and second portion of the base of the structure of the invention overlapping the base of said box,
- the side walls of the structure of the invention being opposed to the side walls of said box, respectively.

Another object of the invention is a substantially flat element comprising a plurality of groovings about which said element is foldable on itself, said element comprising:

- a first section;
- a second trapezoidal rectangular-shaped section connected to said first section by a first grooving made at the side of said trapezoidal shape arranged orthogonal to the largest base and to the smallest base thereof;
- a third section connected to said second section by a second grooving made at the side of said trapezoidal shape opposite to said first grooving (i.e. tilted with respect to the largest base and to the smallest base of said trapezoidal shape);

a fourth section connected to said second section by a third grooving made at a side of said trapezoidal shape interposed between said first and second grooving.

Another object of the invention is a substantially flat element comprising a plurality of groovings about which said element is foldable on itself, said element comprising:

a first section;

a second trapezoidal rectangular-shaped section connected to said first section by a first grooving made at the side of said trapezoidal shape arranged orthogonal to the largest base and to the smallest base thereof;

a third section;

a fourth trapezoidal rectangular-shaped section connected to said third section by a second grooving made at the side of said trapezoidal shape arranged orthogonal to the largest base and to the smallest base thereof;

a fifth and a sixth section connected to each other by at least a third grooving, said fifth section being further connected to said second section by a fourth grooving opposite to said third grooving and made at the side of said trapezoidal shape of said second section opposite to said first grooving (i.e. tilted with respect to the largest base and to the smallest base of said trapezoidal shape), said sixth section being further connected to said fourth section by a fifth grooving opposite to said third grooving and made at the side of said trapezoidal shape of said fourth section opposite to said second grooving (i.e. tilted with respect to the largest base and to the smallest base of said trapezoidal shape), a seventh section connected to said second section by a sixth grooving made at a side of said trapezoidal shape of said second section interposed between said first and fourth grooving;

an eighth section connected to said fourth section by a seventh grooving made at a side of said trapezoidal shape of said fourth section interposed between said second and fifth grooving.

BRIEF DESCRIPTION OF THE DRAWINGS

Further objects and advantages of the present invention will become apparent from the detailed description provided below of an example embodiment thereof and from the accompanying drawings merely given by way of a non-limiting example, in which.

DETAILED DESCRIPTION OF SOME PREFERRED EMBODIMENTS OF THE INVENTION

In the continuation of the present description, a figure may also be shown with reference to elements not expressly indicated in that figure but in other figures. The scale and proportions of the different elements depicted do not necessarily correspond to the actual ones.

Figure 1:
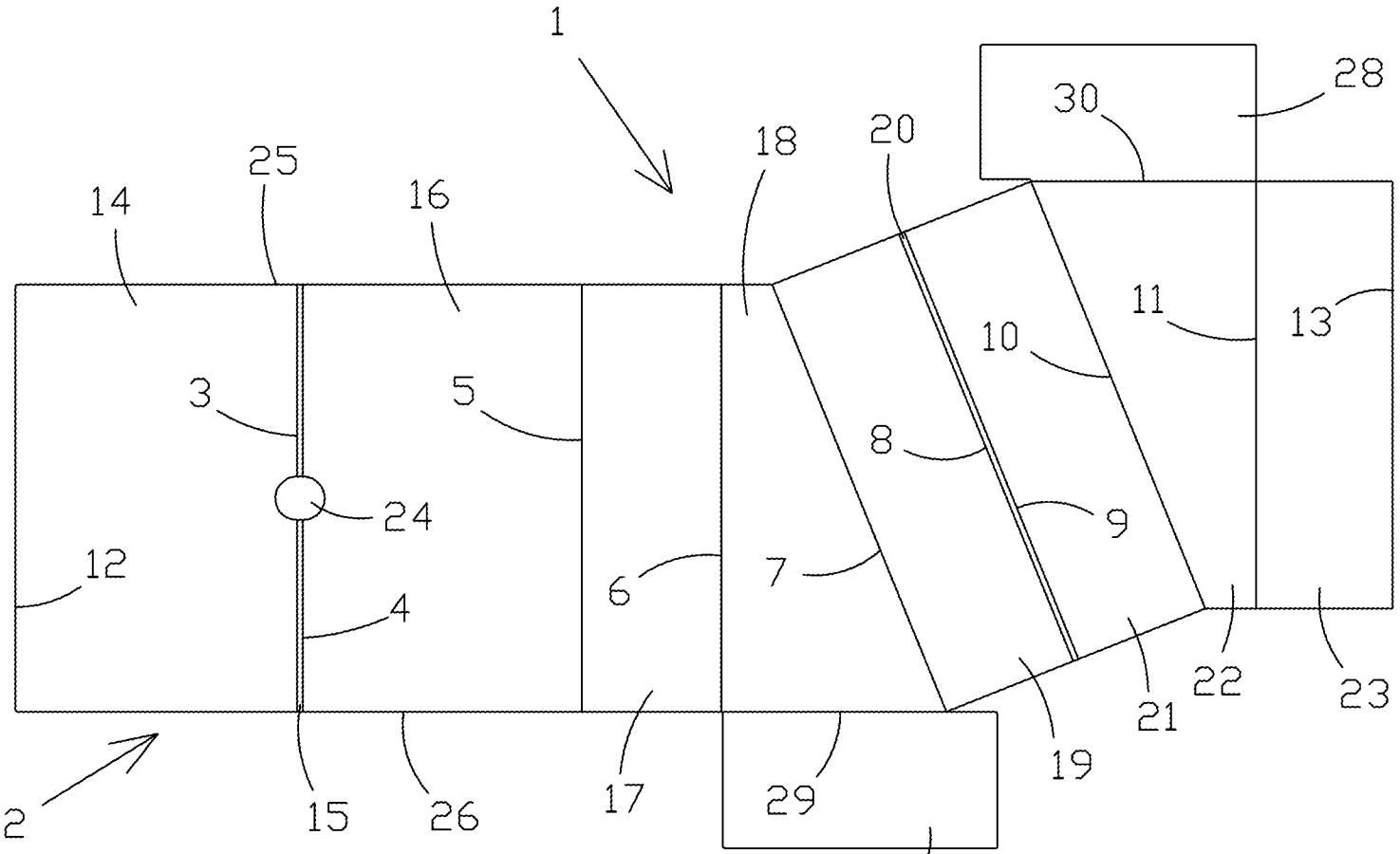
FIG. 1 shows a top plan view of a cut and grooved cardboard sheet according to the present invention, which can be used in making a partition and cover structure according to the present invention.

FIG. 1 shows a substantially flat element 1, object of the invention, foldable on itself in order to obtain a partition and cover structure, it also the object of the invention, that can be accommodated in a shoebox. Element 1 preferably, but not necessarily, is a cut and grooved cardboard sheet, more preferably a corrugated cardboard sheet, even more preferably a microwave corrugated cardboard sheet.

Sheet 1 (shown in FIG. 1, completely unfolded on a surface) comprises a longitudinal band 2 on which transverse groovings 3, 4, 5, 6, 7, 8, 9, 10 and 11 are made, variously spaced apart from one another to delimit, together with the transverse free edges 12 and 13 of band 2, just as many sections 14, 15, 16, 17, 18, 19, 20, 21, 22 and 23. Namely, proceeding in sequence from edge 12 (on the left in FIG. 1) to edge 13 (on the right in FIG. 1):

section 14 is delimited transversely by edge 12 and by grooving 3;

section 15 is delimited transversely by groovings 3 and 4;

section 16 is delimited transversely by groovings 4 and 5;

section 17 is delimited transversely by groovings 5 and 6;

section 18 is delimited transversely by groovings 6 and 7;

section 19 is delimited transversely by groovings 7 and 8;

section 20 is delimited transversely by groovings 8 and 9;

section 21 is delimited transversely by groovings 9 and 10;

section 22 is delimited transversely by groovings 10 and 11;

section 23 is delimited transversely by grooving 11 and by edge 13.

The sections 14, 16 and 17 preferably are rectangular, with the long sides arranged at edge 12, respectively, and at groovings 3, 4, 5 and 6. By defining "length" as the dimension of the aforesaid sections orthogonal to edge 12 and "width" as the dimension of the aforesaid sections parallel to edge 12, the sections 14, 16 and 17 preferably have the same width. More preferably, the edges of the sections 14, 16 and 17 corresponding to the short sides thereof, respectively, lying on the same side with respect to the groovings 3, 4, 5 and 6, are aligned with one another so that the portion of band 2 delimited transversely by edge 12 and by grooving 6 is shaped as a rectangle. The sections 14 and 16 preferably also have the same length. More preferably, each of the sections 14 and 16 has a length which is almost equal to twice the length of section 17. The width of each of the sections 14, 16 and 17 preferably is almost equal to three times the length of section 17.

Section 15 has a much smaller length than the one of the sections 14, 16 and 17. More preferably, section 15 has a length almost equal to twice the thickness of sheet 1. According to a variant of sheet 1, the sections 14 and 16 are mutually connected by a single grooving rather than being connected to each other by section 15 and by the groovings 3 and 4.

As may be noted in FIG. 1, band 2 comprises a preferably circular through hole 24 made at the sections 14, 15 and 16. Namely, hole 24 preferably is made in middle position so as to be both equidistant from edge 12 and from grooving 5, and equidistant from the longitudinal free edges 25 and 26 of the portion of band 2 delimited transversely by edge 12 and by grooving 6.

Section 18 preferably is trapezoidal rectangular, with the edges corresponding to the smallest base and to the largest base preferably aligned (i.e. adjacent) with the edges 25 and 26, respectively, the height (i.e. the side orthogonal to the aforesaid bases) at grooving 6 and the oblique side (i.e. the side opposite to the height) at grooving 7. The largest base of section 18 has a length preferably almost equal to one and a half times the length of section 17. The smallest base of section 18 has a length preferably almost equal to half the length of section 17.

The sections 19 and 21 preferably are rectangular, with the long sides arranged at groovings 7, 8, 9 and 10, respectively. By defining "length" as the dimension of the aforesaid sections orthogonal to groovings 7, 8, 9 and 10, and "width" as the dimension of the aforesaid sections parallel to the groovings 7, 8, 9 and 10, the sections 19 and 21 preferably have the same width. More preferably, the edges of the sections 19 and 21 corresponding to the short sides thereof, respectively, lying on the same side with respect to the groovings 7, 8, 9 and 10 are aligned with one another so that the portion of band 2 delimited transversely by the groovings 7 and 10 is shaped as a rectangle. As shown in FIG. 1, the edges of section 19 corresponding to the short sides thereof preferably, but not necessarily, are consecutive to the edges of section 18 corresponding to the largest base and to the smallest base of the latter, respectively. The width of the sections 19 and 21 therefore is almost equal to the length of the oblique side of section 18 (i.e. to the length of grooving 7). The sections 19 and 21 preferably have the same length. More preferably, each of the sections 19 and 21 has a length which is almost equal to the length of section 17. In light of what is said, the sections 19 and 21 preferably are almost equal to each other.

Section 20 has a much smaller length than the one of the sections 19 and 21. More preferably, as section 15, section 20 has a length almost equal to twice the thickness of sheet 1. According to a variant of sheet 1, rather than being connected to each other by section 20 and by the groovings 8 and 9, the sections 19 and 21 are mutually connected by a single grooving.

Section 22 preferably is trapezoidal rectangular, with the oblique side at grooving 10 and the height at grooving 11. As shown in FIG. 1, the edges of section 22 corresponding to the largest base and to the smallest base thereof preferably, but not necessarily, are consecutive to the edges of section 21 corresponding to the short sides of the latter, respectively. Section 22 preferably is almost equal to section 18, but rotated by 180° with respect to the latter, so that the edges of the sections 18 and 21 corresponding to the bases thereof are parallel to each other (and accordingly also to the edges 25 and 26).

Section 23 is preferably rectangular, with the long sides arranged at grooving 11 and edge 13, respectively. The edges of section 23 corresponding to the short sides thereof preferably are aligned (i.e. adjacent) with the edges of section 22 corresponding to the largest base and to the smallest base of the latter, respectively. The edges of section 23 corresponding to the short sides thereof therefore are parallel to the edges 25 and 26. Section 23 preferably is almost equal to section 17.

Sheet 1 comprises two further sections 27 and 28, preferably rectangular, connected to band 2 by means of two respective groovings 29 and 30. Namely, section 27 is connected, at an edge coincident with a long side thereof, to the largest base of section 18 by means of grooving 29. Similarly, section 28 is connected, at an edge coincident with a long side thereof, to the largest base of section 22 by means of grooving 30. In light of what is said, the sections 27 and 28 lie on opposite sides with respect to band 2 and are arranged with the edges corresponding to the long sides thereof parallel to the edges 25 and 26. By defining "length" as the dimension of the aforesaid sections parallel to groovings 29 and 30, and "width" as the dimension of the aforesaid sections orthogonal to the groovings 29 and 30, the sections 27 and 28 preferably have the same length. More preferably, each of the sections 27 and 28 has a length which is almost equal to twice the length of section 17. The sections 27 and 28 preferably also have the same width, i.e. they are almost equal to each other. More preferably, each of the sections 27 and 28 has a width which is almost equal to the length of section 17. As shown in FIG. 1, an edge of section 27 corresponding to a short side thereof preferably is aligned with the edge of section 18 corresponding to the height of the latter (i.e. preferably it is adjacent to grooving 6). Given that section 27 has a greater length than the one of the largest base of section 18 (preferably almost equal to one and a half times the length of section 17), section 27 protrudes longitudinally for a short stretch past the end of the oblique side of section 18 corresponding to an end of grooving 29. Similarly, an edge of section 28 corresponding to a short side thereof preferably is aligned with the edge of section 22 corresponding to the height of the latter (i.e. preferably it is adjacent to grooving 11). Given that section 28 has a greater length than the one of the largest base of section 22, section 28 protrudes longitudinally for a short stretch past the end of the oblique side of section 22 corresponding to an end of grooving 30.

Incidentally, one or more sections 14, 16, 17, 19, 21, 23, 27 and 28 could be square rather than preferably being rectangular.

Figure 2:
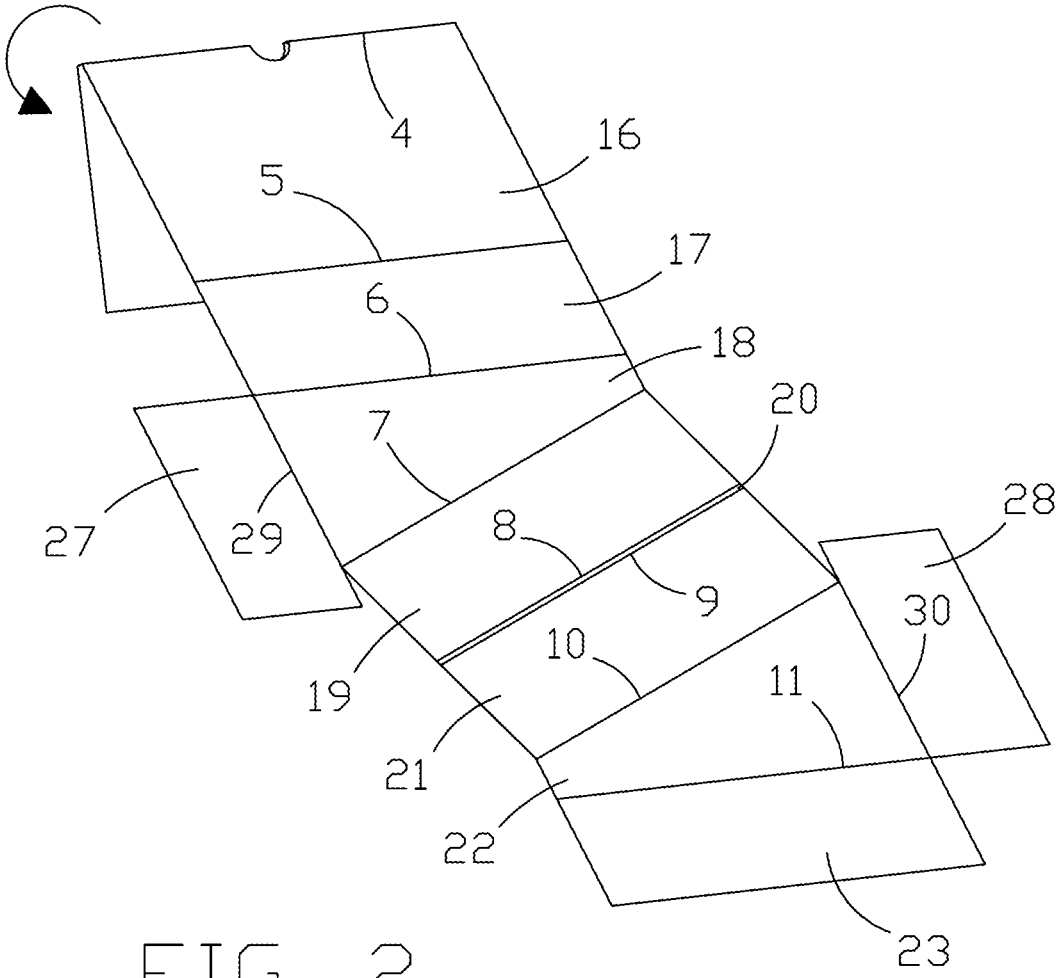
FIGS. 2 and 3 show a perspective diagrammatic view of respective steps of folding the sheet in FIG. 1 to obtain a partition and cover structure according to the present invention.

FIG. 2 shows sheet 1 during a folding of 180° of section 14 with respect to section 16 about the groovings 3 and 4.

Incidentally, if the sections 14 and 16 are connected to each other by a single grooving rather than by section 15 and by the groovings 3 and 4, section 14 is folded by 180° with respect to section 16 about said single grooving.

Figure 3:
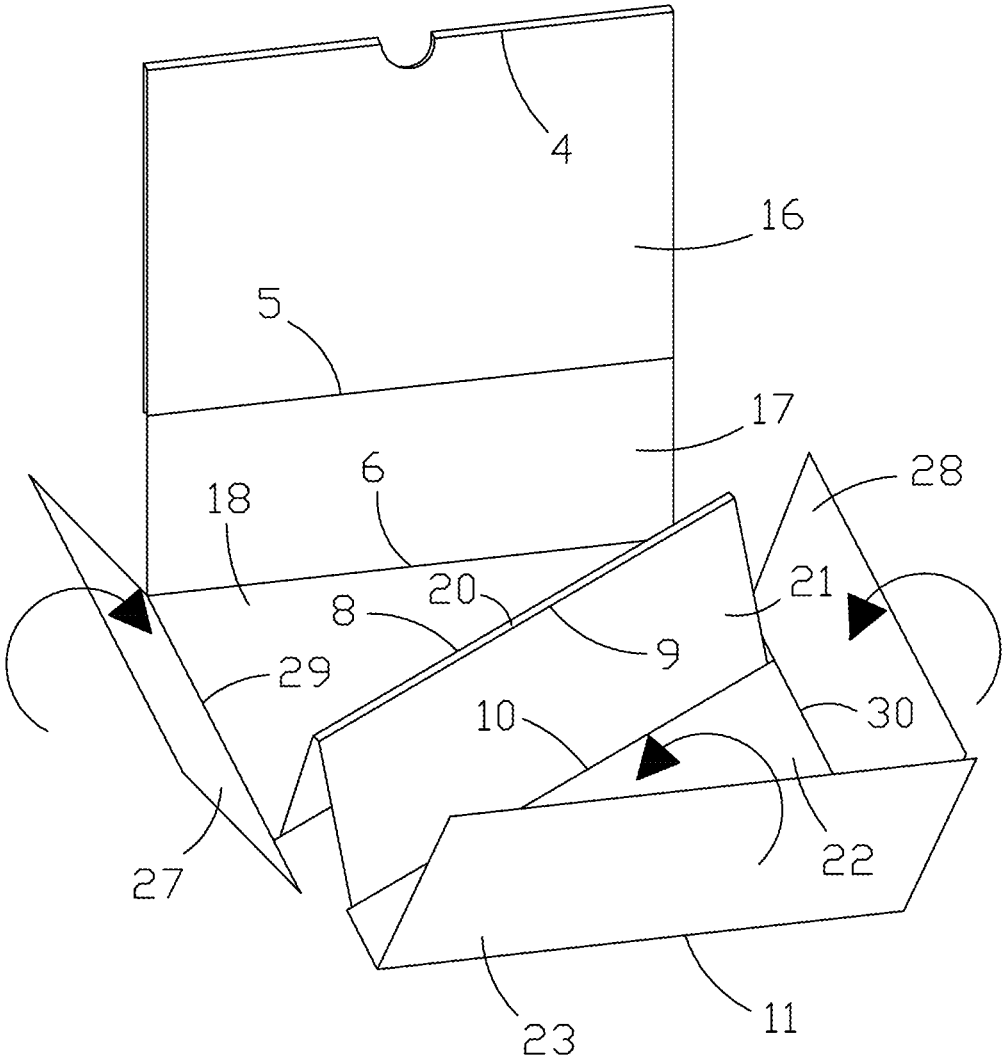

FIG. 3 shows sheet 1 at the end of the folding in FIG. 2, i.e. with section 14 opposed to section 16, preferably in contact therewith, and section 15 arranged almost orthogonal to sections 14 and 16. An adhesive substance may be interposed between the faces of the opposed sections 14 and 16. Said adhesive substance advantageously contributes to keeping the sections 14 and 16 folded by 180° with respect to each other, thus overcoming the possible elastic return of sheet 1.

FIG. 3 shows sheet 1 during the following further folding operations:

- a folding, preferably by 90°, of section 17 (and with it, of sections 14, 15 and 16) with respect to section 18 about grooving 6;
- a folding, preferably by 90°, of section 27 with respect to section 18 about grooving 29;
- a folding, preferably by 90°, of section 28 with respect to section 22 about grooving 30;
- a folding, preferably by 90°, of section 23 with respect to section 22 about grooving 11;
- a folding, preferably by 90°, of section 19 with respect to section 18 about grooving 7;
- a folding—preferably by 90°—of section 21 with respect to section 22 about grooving 10;
- a folding, preferably by 180°, of section 19 with respect to section 21 about the groovings 8 and 9.

With reference to the plane on which sheet 1 is lying in FIG. 1, with regard to the sections 18 and 22, the sections 17, 23, 27 and 28 are folded on the opposite side with respect to the folding of section 14 with regard to section 16. In other words, by taking as upper face of sheet 1 the one facing the observer in FIGS. 1 to 3, section 14 is caused to rotate downwards with respect to section 16, while sections 17, 23, 27 and 28 are caused to rotate upwards with respect to sections 18 and 22.

Similarly, with regard to the sections 18 and 22, the sections 19 and 21 are folded on the opposite side with respect to the folding of section 14 with regard to section 16. That is, the sections 19 and 21 are caused to rotate upwards with respect to the sections 18 and 22, as sections 17, 23, 27 and 28.

Conversely, with regard to section 21, section 19 is folded from the same side with respect to the folding of section 14 with regard to section 16. That is, section 19 is caused to rotate downwards with respect to section 21.

Incidentally, if the sections 19 and 21 are connected to each other by a single grooving rather than by section 20 and by the groovings 8 and 9, section 19 is folded by 180° with respect to section 21 about said single grooving.

Figure 4:
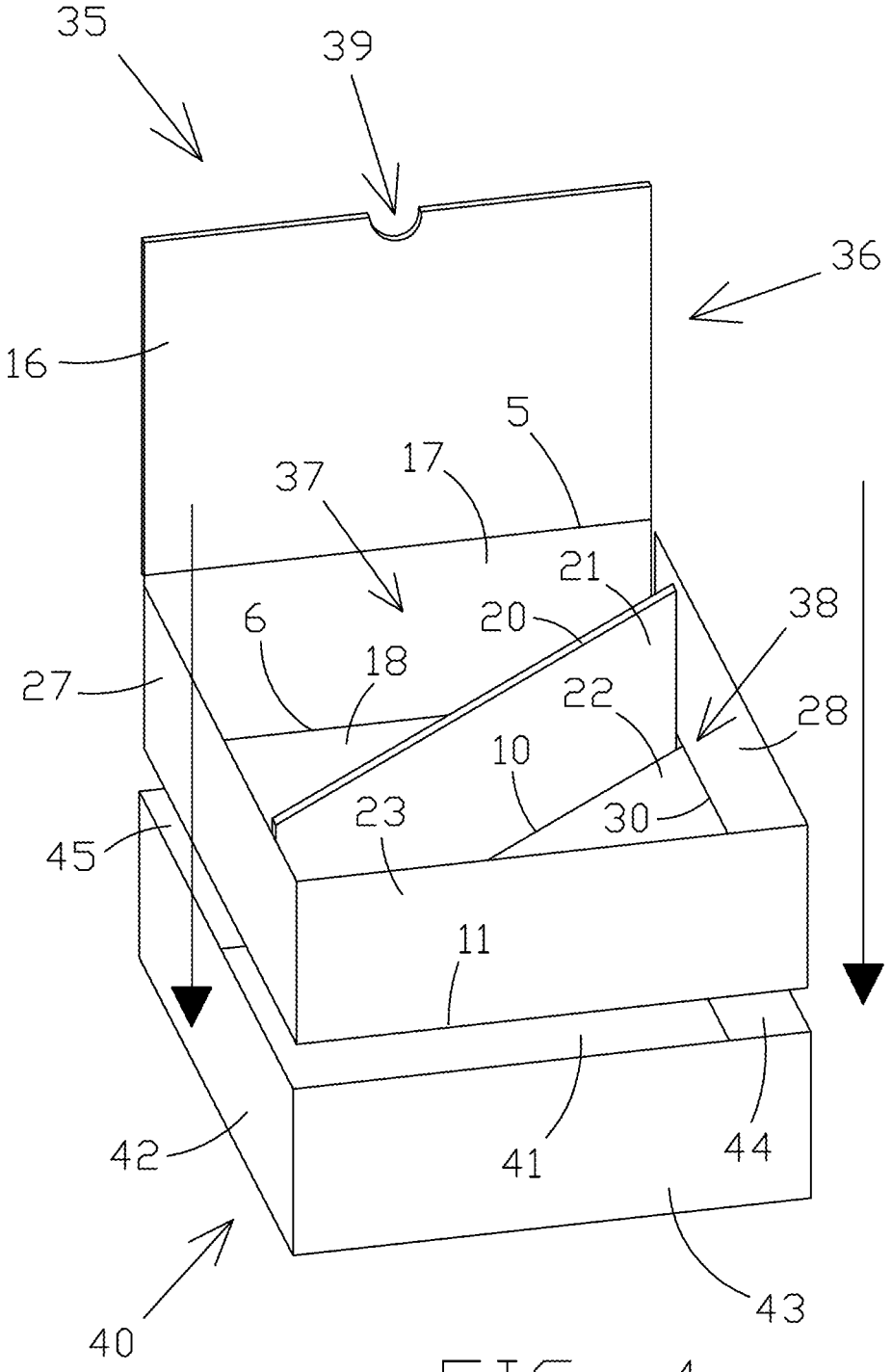
FIG. 4 shows a perspective diagrammatic view of a partition and cover structure according to the present invention, obtained from the sheet in FIG. 1, when the same is being inserted into a shoebox.

FIG. 4 shows sheet 1 at the end of the folding operations in FIG. 3, i.e. with:

- sections 17 and 27 arranged both orthogonal to each other and orthogonal to section 18;
- sections 23 and 28 arranged both orthogonal to each other and orthogonal to section 22;
- sections 19 and 21 arranged orthogonal to sections 18 and 22, respectively;
- section 19 opposed to section 21, preferably in contact therewith, and section 20 arranged almost orthogonal to sections 19 and 21.

As mentioned above, sections 19 and 21 preferably are rectangular and equal to each other. Due to this, at the end of the folding operations in FIG. 3, the sections 18 and 22 preferably are coplanar and substantially consecutive to each other at the folds originating from the groovings 7 and 10, respectively. Additionally:

- given that the sections 17, 23, 27 and 28 preferably are rectangular, and
- given that the sections 17 and 23 preferably have the same length and the sections 27 and 28 have a width preferably equal to the length of section 17, the edges of the sections 17, 23, 27 and 28 opposite to the groovings 6, 11, 29 and 30, respectively, preferably are coplanar and parallel to the sections 18 and 22.

An adhesive substance may be interposed between the faces of the opposed sections 19 and 21. Said adhesive substance advantageously contributes to keeping the sections 19 and 21 folded by 180° with respect to each other, thus overcoming the possible elastic return of sheet 1.

As may be noted in FIG. 4, the length of each of the sections 27 and 28 preferably is almost equal to the sum of the lengths of the smallest base and of the largest base of each of the sections 18 and 22. Due to this, at the end of the folding operations in FIG. 3, the stretch of longitudinal edge of section 27 which protrudes past grooving 7 is almost opposed to the edge of section 22 corresponding to the smallest base thereof. Similarly, the stretch of longitudinal edge of section 28 which protrudes past grooving 10 is almost opposed to the edge of section 18 corresponding to the smallest base thereof. In light of what is said, at the end of the folding operations in FIG. 3, the sections 18 and 22 form a substantially square- or rectangular-shaped base, preferably shaped as the sections 14 and 16, and enclosed between four side walls coincident with the sections 17, 23, 27 and 28, respectively.

Namely, at the end of the folding operations in FIG. 3, sheet 1 is as a structure 35, object of the invention, as sheet 1, comprising:

- a base divided into two portions coincident with the sections 18 and 22, respectively;
- a first partition wall, coincident with section 19, connected to portion 18 by means of a fold originating at grooving 7;
- a second partition wall, coincident with section 21, connected to portion 22 by means of a fold originating at grooving 10;
- four side walls, coincident with the sections 17, 23, 27 and 28, respectively, two-by-two mutually opposite with respect to the aforesaid base. Namely:
  - wall 17 is connected to portion 18 by means of a fold originating at grooving 6;
  - wall 23 is connected to portion 22 by means of a fold originating at grooving 11;
  - wall 27 is connected to portion 18 by means of a fold originating at grooving 29;
  - wall 28 is connected to portion 22 by means of a fold originating at grooving 30;
- a lid 36, coincident with the sections 14, 15 and 16, connected to wall 17 by means of grooving 5.

Wall 21 is also connected to wall 19 by means of section 20 and the folds originating at the groovings 8 and 9, respectively. Incidentally, if the sections 19 and 21 are connected to each other by a single grooving rather than by section 20 and by the groovings 8 and 9, wall 21 is connected to wall 19 by means of a single fold originating at said single grooving.

Due to the connection by means of one or more folds between the walls 19 and 21, the latter are opposable to each other. Additionally, as shown in FIG. 3, the walls 19 and 21 are shaped in such a manner whereby when they are opposed to each other (as shown in FIG. 4), the base portions 18 and 22 substantially are consecutive to each other at the two edges where two folds originated from the groovings 7 and 10, respectively.

Incidentally, in structure 35:

- the folds originating at the groovings 6, 7 and 29 are at respective edges of portion 18;
- the folds originating at the groovings 10, 11 and 30 are at respective edges of portion 22;
- the folds originating at the groovings 7 and 8 are at two mutually opposite edges of wall 19;
- the folds originating at the groovings 9 and 10 are at two mutually opposite edges of wall 21.

Lid 36 is foldable by 90° with respect to wall 17, about grooving 5 so as to be orientable parallel to the portions 18 and 22. If lid 36 is folded by 90° with respect to wall 17, at the end of said folding lid 36 is also almost coplanar to the edges of the walls 17, 22, 27 and 28 opposite to the portions 18 and 22 (i.e. upper in FIG. 4).

The sections 14 and 16, and therefore lid 36, preferably are shaped as a rectangle (or square) which is almost equal to the base of structure 35, i.e. to the combination of the portions 18 and 22. In virtue of this, the portions 18 and 22, together with the four walls 17, 23, 27 and 28, delimit a seat which can be closed at the top (i.e. on the side opposite to the portions 18 and 22) by lid 36 and divided, by walls 19 and 21, into two compartments 37 and 38 almost shaped as prisms having trapezoidal rectangular base.

As may be noted in FIGS. 3 and 4, given that hole 24 preferably is made in middle position (so as to be both equidistant from edge 12 and from grooving 15, and equidistant from the edges 25 and 26), hole 24 becomes a notch 39 at the free edge of lid 36 opposite to grooving 5 (or from the fold originating at the latter) following the folding of section 14 by 180° with respect to section 16. Advantageously, when lid 36 is arranged parallel to the portions 18 and 22, i.e. when it closes the aforesaid seat at the top, a user of structure 35 may easily raise lid 36 (causing it to rotate about wall 17) by simply inserting a finger into notch 39.

As described above, the side walls 17, 23, 27 and 28 are connected to the portions 18 and 22 by means of folds originating at the groovings 6, 11, 29 and 30. This constitutes a single possible variant of how the side walls 17, 23, 27 and 28 are connected to the portions 18 and 22. For the purposes of the invention, it indeed is sufficient for at least one of the side walls 17, 23, 27 and 28 to be connected, by means of at least one fold, to portion 18 or 22, and for each of the side walls 17, 23, 27 and 28 to be connected, by means of at least one fold, to portion 18 or 22 or to another of the side walls 17, 23, 27 and 28.

As may be noted in FIGS. 3 and 4, the partition walls 19 and 21 are tilted with respect to the side walls 17, 23, 27 and 28. Alternatively, the partition walls 19 and 21 could be arranged parallel to the side walls 17 and 23 and orthogonal to the side walls 27 and 28. Here, the sections 18 and 22 of sheet 1 are rectangular- or square-shaped and band 2 therefore is shaped as a rectangle which extends from edge 12 to edge 13.

Sheet 1 (and accordingly, also structure 35) preferably, but not necessarily, is at least partly covered at a face thereof by at least one layer made of one or more protective materials preferably selected in the group comprising fabric, non-woven fabric, paint (more preferably non-scratch paint) and polymeric materials (more preferably polyethylene). With reference to FIG. 1, the face of sheet 1, which preferably is covered, is the upper one, i.e. the one facing the observer. Due to this, all the inner faces of structure 35 are covered, i.e. the faces of the portions 18 and 22 of the side walls 17, 23, 27 and 28, of the partition walls 19 and 21 and of lid 36, which internally delimit the aforesaid seat defined by structure 35. The layer of protective material advantageously avoids a contact (and therefore a rubbing) between an object possibly accommodated in structure 35 (such as for example, a pair of shoes) and sheet 1 in which the portions of base, the walls and the lid thereof are made.

As described above, lid 36 comprises the sections 14, 15 and 16 of sheet 1.

The folding of section 14 with respect to section 16 moreover occurs on the opposite side with respect to the folding of the sections 17, 27 and 23, 28 with respect to the sections 18 and 22. Due to this, if sheet 1 is covered by a layer of protective material, not only is said covering present at the inner face of lid 36 (i.e. the one facing the portions 18 and 22 when lid 36 is arranged parallel thereto), but also at the outer face of the latter. Due to this, starting from a configuration in which lid 36 is arranged parallel to the portions 18 and 22, when a user of structure 35 slips a finger into notch 39 to open the latter, said user tactilely perceives the presence of the protective material at both the faces of lid 36. This advantageously gives the user a sense of complete protection of the possible contents in structure 35.

FIG. 4 shows structure 35 during the insertion thereof into a shoebox 40 comprising a rectangular or square base 41 and four side walls 42, 43, 44 and 45, they also being rectangular or square, which are connected transversely to base 41 at respective edges thereof. Base 41 and the walls 42, 43, 44 and 45 delimit a seat in which a pair of shoes can be accommodated. Structure 35 can also be accommodated at said seat. Namely, from the configuration of structure 35 shown in FIG. 4 (i.e. with:

- the portions 18 and 22 coplanar and substantially consecutive to each other at the two edges where two folds originated from the groovings 7 and 10, respectively.
- the partition walls 19 and 21 opposed to each other; and
- the side walls 17, 23, 27 and 28 orthogonal to the portions 18 and 22) by shaping structure 35 preferably so that:
- the base thereof substantially has the same extension as base 41, so as to overlap the latter, and
- the side walls 17, 23, 27 and 28 substantially have the same extension as the side walls 45, 43, 42 and 44, respectively, so as to overlap the same, structure 35 can be accommodated in box 40 so that the portions 18 and 22 overlap base 41 and the side walls 17, 23, 27 and 28 are opposed to the side walls 45, 43, 42 and 44, respectively.

In light of what said, structure 35 is suitable for serving as partition and cover structure of a shoebox. Incidentally, if structure 35 is accommodated in box 40, a pair of shoes advantageously can be accommodated in structure 35 in such a manner whereby the soles are mutually parallel and the uppers are mutually opposed, i.e. namely in such a manner whereby each shoe is accommodated in one of the compartments 37 and 38 with a side portion of the upper resting on one of the portions 18 and 22 and with the sole opposed to one of the side walls 17 and 23. The partition walls 19 and 21 prevent there from being any contact between the aforesaid shoes of the same pair.

In addition to sheet 1 and structure 35, box 40, including structure 35 accommodated therein as described above, also is an object of the invention.

Certain variants of sheet 1, which reflect just as many variants of structure 35, are disclosed in the description below. Said variants of structure 35 can be equivalently accommodated in box 40, as structure 35. Incidentally, just as sheet 1, structure 35 and box 40 including structure 35 are an object of the invention; the variants of sheet 1 disclosed below, the variants of structure 35 originating from said variants of sheet 1 and box 40, including one of said variants of structure 35 accommodated therein, fall within the scope of the invention.

Figure 5:
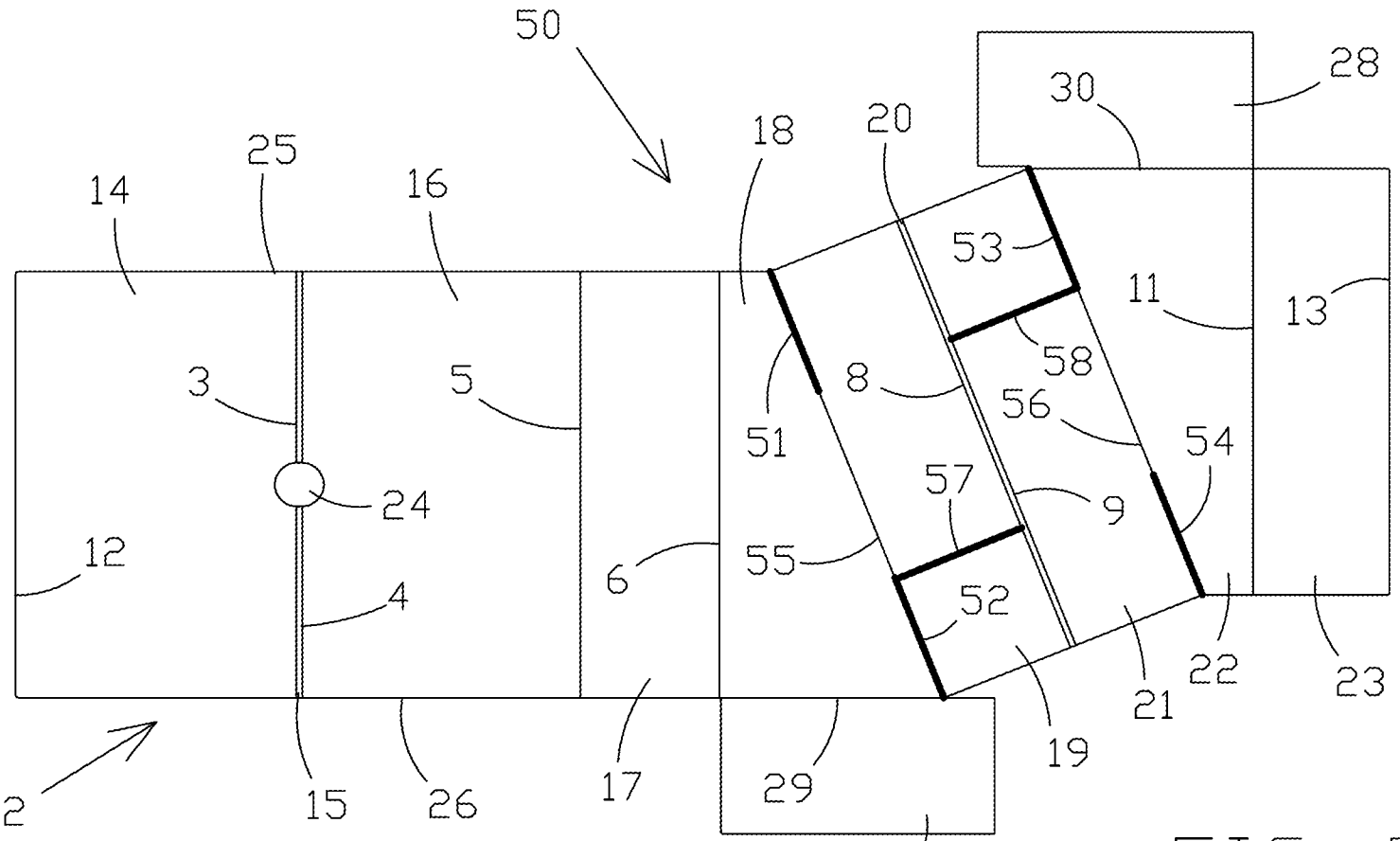
FIG. 5 shows a top plan view of a first variant of the sheet in FIG. 1, which can be used in making a first variant of the structure in FIG. 4.

FIG. 5 shows a substantially flat element 50 foldable on itself which differs from element 1 in that it includes four through cuts 51, 52, 53 and 54 in place of two mutually opposite end stretches of each of the groovings 7 and 10. In other words, although they are consecutive to the sections 18 and 22, respectively, the sections 19 and 21 are separate from the latter at the aforesaid end stretches 51, 52, 53 and 54. Namely, in place of grooving 7 in element 50, there is a middle grooving 55 (which mutually connects the sections 18 and 19) interposed between the cuts 51 and 52. Similarly, in place of grooving 10, there is a middle grooving 56 (which mutually connects the sections 21 and 22) interposed between the cuts 53 and 54. In light of what is said, the edge of section 19 corresponding to the long side thereof opposite to grooving 8 is separate from the edge of section 18 corresponding to the oblique side thereof, at two end stretches coincident with the cuts 51 and 52. Similarly, the edge of section 21 corresponding to the long side thereof opposite to grooving 9 is separate from the edge of section 22 corresponding to the oblique side thereof, at two end stretches coincident with the cuts 53 and 54. The cuts 51, 52, 53 and 54 preferably have almost the same length.

Preferably, but not necessarily, element 50 differs from element 1 also in that it includes two further cuts 57 and 58, preferably, through cuts, at the sections 19 and 21, respectively. Namely, cut 57 is made in section 19 and extends from grooving 8 at the end of cut 52 coincident with an end of grooving 55. Cut 58 is made in section 21 and extends from grooving 9 at the end of cut 53 (i.e. the cut the furthest from cut 52 or 57) coincident with an end of grooving 56. The cuts 57 and 58 preferably are arranged orthogonal to the groovings 8 and 9.

Alternatively to being made in the sole sections 19 and 21, the cuts 57 and 58, when present, extend into section 20. Here, cut 57 extends preferably orthogonal from grooving 9 rather than from grooving 8, and cut 58 extends preferably orthogonal from grooving 8 rather than from grooving 9.

Incidentally, if the sections 19 and 21 are connected to each other by a single grooving rather than by section 20 and by the groovings 8 and 9, the cuts 57 and 58 extend preferably orthogonal from said single grooving.

Figure 6:
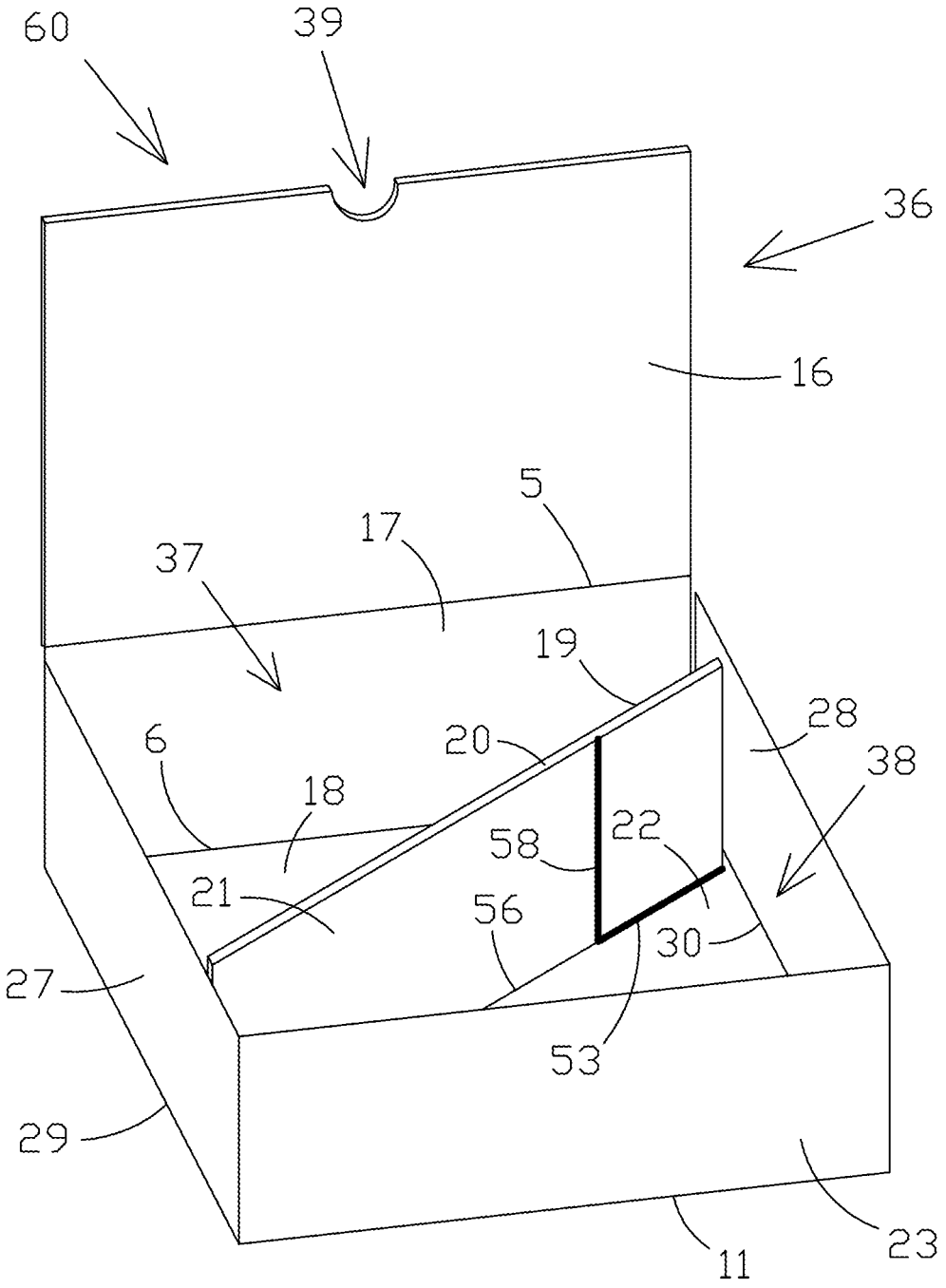
FIG. 6 shows a perspective diagrammatic view of a first variant of the structure in FIG. 4, obtained from the sheet in FIG. 5.

FIG. 6 shows a structure 60 obtained from element 50 by carrying out thereon the same folding carried out to make structure 35 from element 1. Structure 60 thus constitutes a variant of structure 35.

Figure 7:
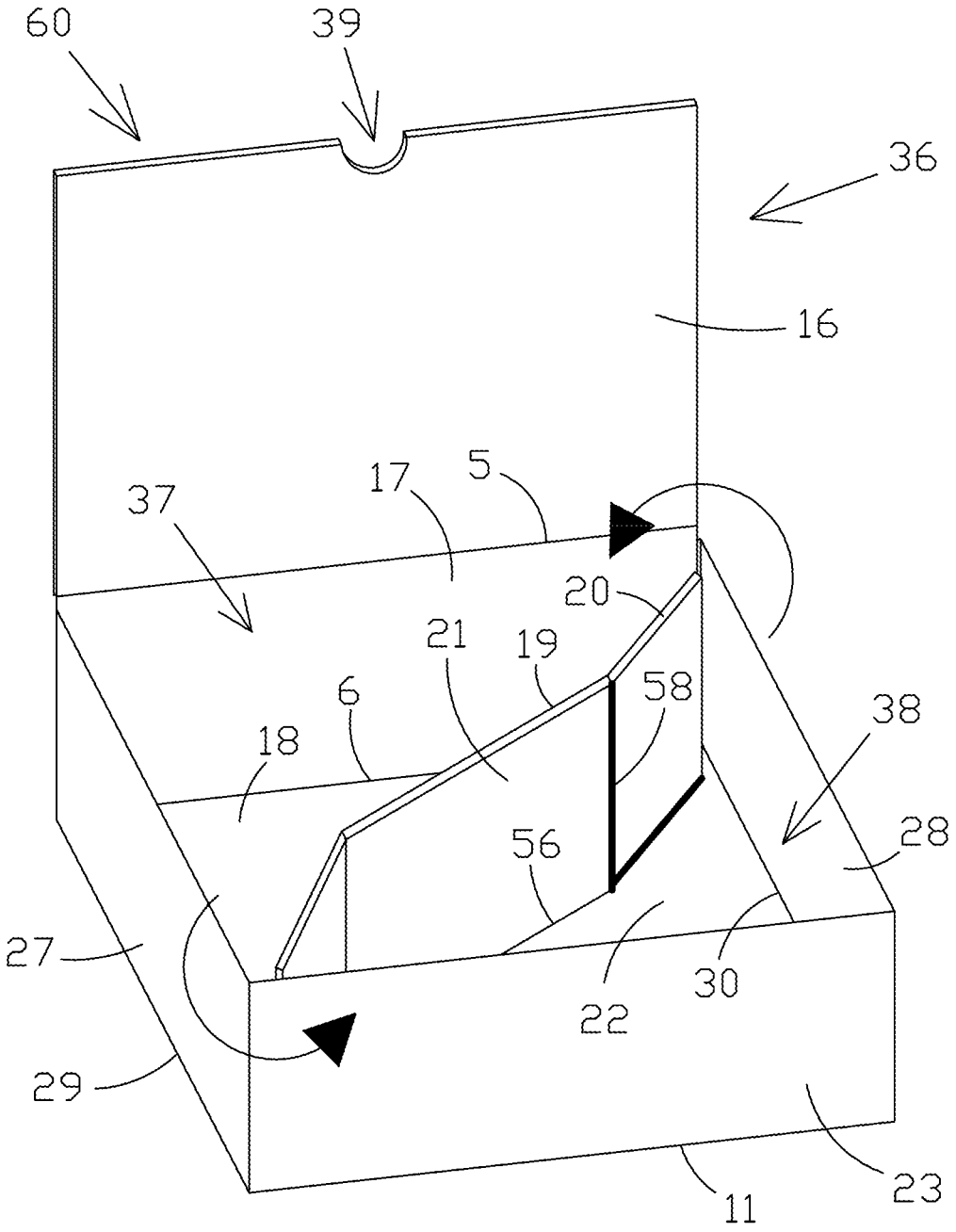
FIG. 7 shows a perspective diagrammatic view of the structure in FIG. 6 with the partition walls partly folded on themselves at two mutually opposite end portions thereof.

FIG. 7 shows structure 60 during two folding operations of each of the two partition walls 19 and 21 onto itself. Namely:

wall 19 is folded towards wall 17 along a line opposed to cut 58 (and therefore transverse to the base portion 18). Said fold line may advantageously be grooved. Given that the walls 19 and 21 are opposed to each other, by folding the portion of wall 19 separate from the base portion 18 towards wall 17, it drags with it the portion of wall 21 (opposed thereto) separate from the base portion 22. Said dragging takes place due to the connection made between the walls 19 and 21 of section 20 and by the groovings 8 and 9 (or alternatively, by the grooving mentioned above);

wall 21 is folded towards wall 23 along a line opposed to cut 57 (and therefore transverse to the portion of base 22). Said fold line may advantageously be grooved. Given that the walls 19 and 21 are opposed to each other, by folding the portion of wall 21 separate from the base portion 22 towards wall 23, it drags with it the portion of wall 19 (opposed thereto) separate from the base portion 18. Said dragging takes place due to the connection made between the walls 19 and 21 of section 20 and by the groovings 8 and 9 (or alternatively, by the grooving mentioned above).

In light of what is said, cut 58 extends from one end of the end stretch 53 not opposed to the end stretch 52 from which end cut 57 extends (when the base portions 18 and 22 substantially are consecutive to each other at the two edges where two folds originated respectively from the groovings 55 and 56).

Incidentally, the folding of the walls 19 and 21 results in an equivalent folding of section 20 on itself at two mutually opposite end portions thereof. One of said portions is folded towards wall 17, the other towards wall 23. Similarly, if the sections 19 and 21 are connected to each other by a single grooving rather than by section 20 and by the groovings 8 and 9, the folding of the walls 19 and 21 results in an equivalent folding of said single grooving on itself at two mutually opposite end stretches thereof.

According to this variant of structure 35, the dimensions of the compartments 37 and 38 advantageously may be adapted to the height of the heel of the pair of shoes to be accommodated therein. Cut 57 or 58 in one of the partition walls 19 or 21, when present, advantageously facilitates the folding of the other partition wall 21 or 19 along a line opposed to said cut 57 or 58.

Figure 8:
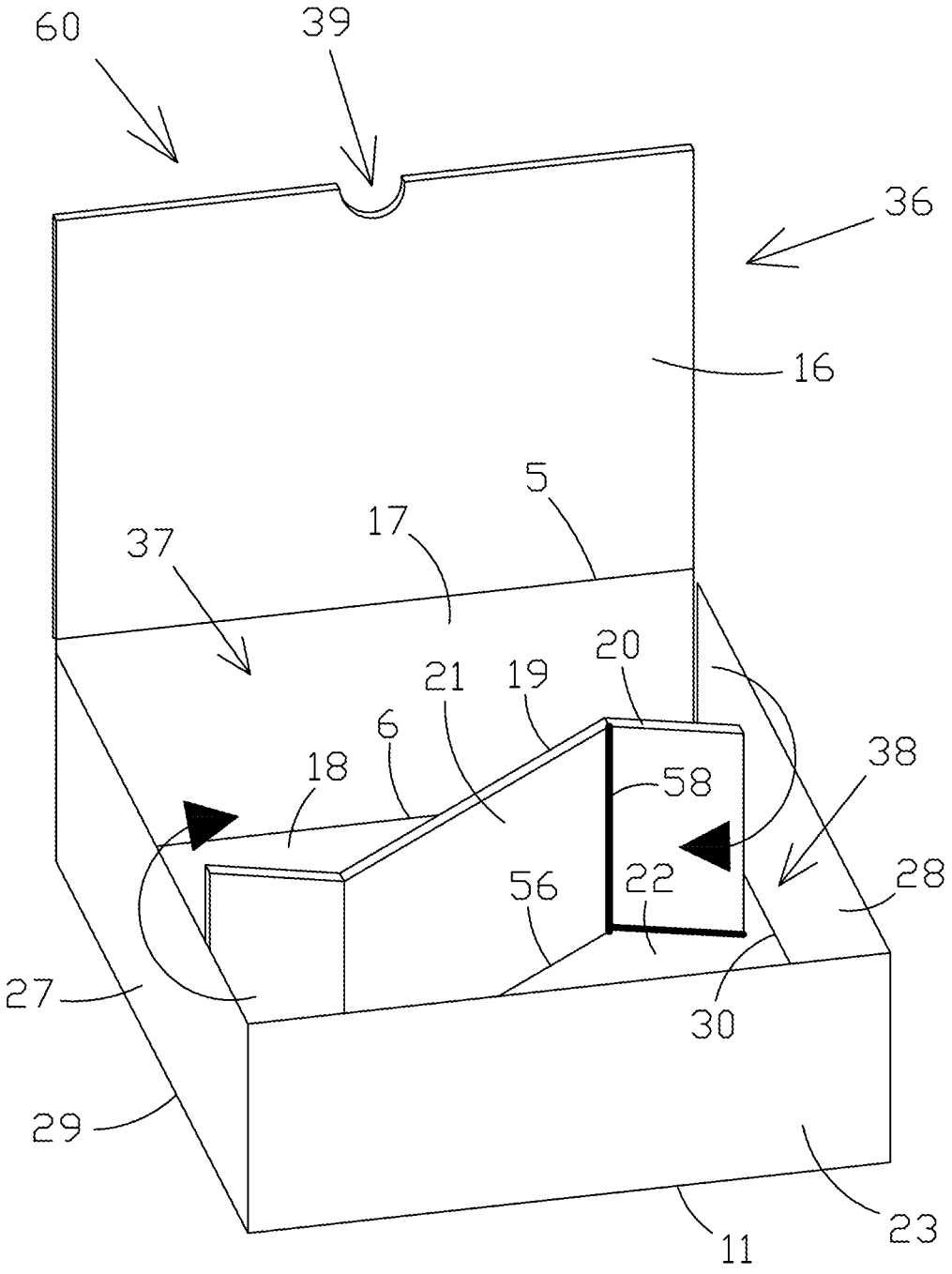
FIG. 8 shows a perspective diagrammatic view of the structure in FIG. 6 with the partition walls partly folded on themselves at two mutually opposite end portions thereof, in a direction opposite to the one of the corresponding folding operations shown in FIG. 7.

FIG. 8 shows structure 60 during two folding operations of each of the two partition walls 19 and 21 onto itself, in a direction opposite to the one of the corresponding folding operations shown in FIG. 7. Here, the sections 19 and 21 have a width which is preferably less than the length of the oblique sides of the sections 18 and 22. The short sides of the sections 19 and 21 here are not consecutive to the largest and smallest sides of the sections 18 and 22.

Figure 9:
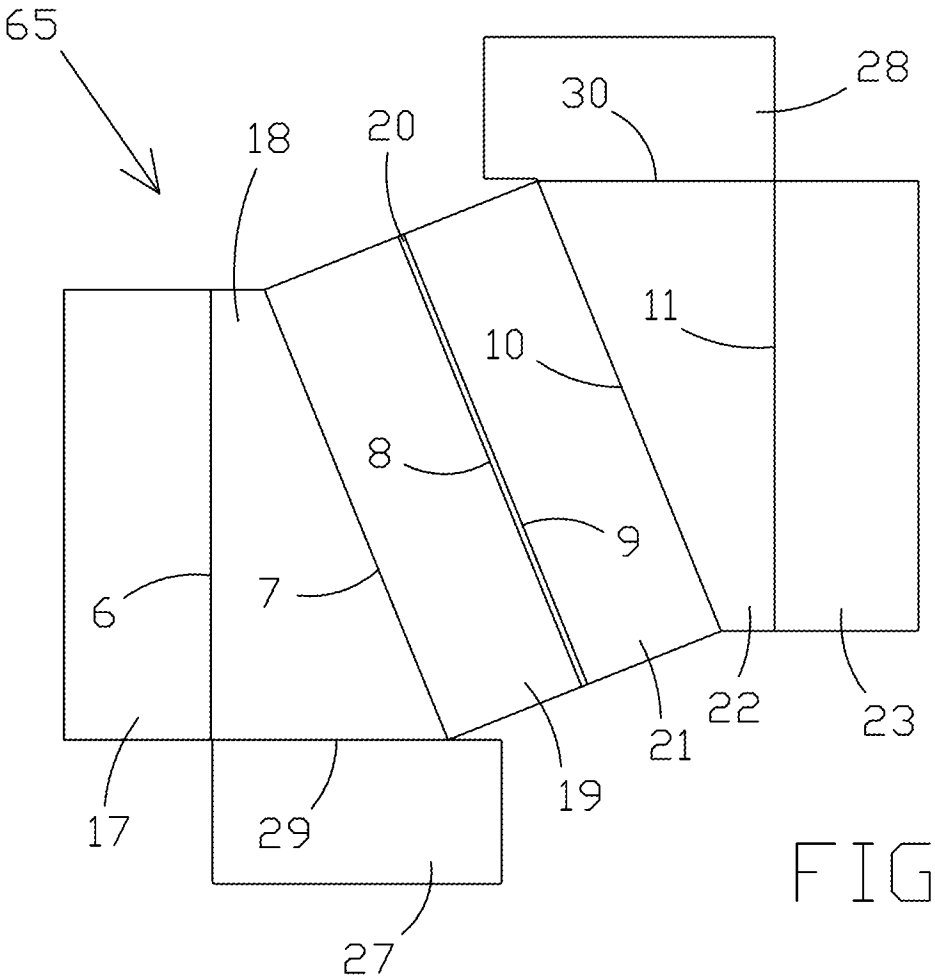
FIG. 9 shows a top plan view of a second variant of the sheet in FIG. 1, which can be used in making a second variant of the structure in FIG. 4.

FIG. 9 shows a substantially flat element 65 foldable on itself which differs from element 1 in that it does not have sections 14, 15 and 16.

Figure 10:
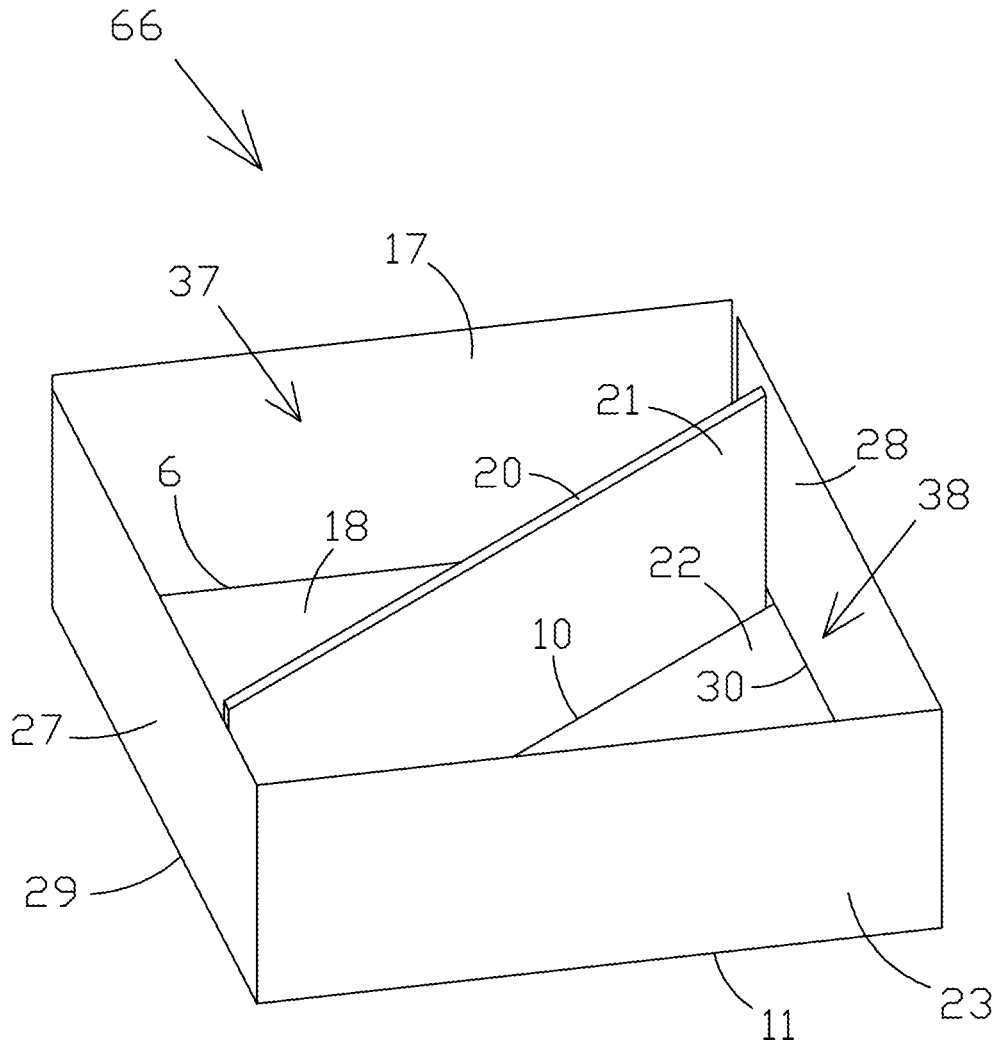
FIG. 10 shows a perspective diagrammatic view of a second variant of the structure in FIG. 4, obtained from the sheet in FIG. 9.

FIG. 10 shows a structure 66 obtained from element 65 by carrying out thereon the same folding operations carried out to make structure 35 from element 1 (except for the folding of section 14 with respect to section 16). Structure 66 thus constitutes a variant of structure 35 and differs from the latter due to the absence of lid 36.

Incidentally, the cuts 51, 52, 53 and 54, and possibly also the cuts 57 and 58, may equivalently be made in element 65. Here, said cuts 51, 52, 53 and 54, and possibly also 57 and 58, are also found in structure 66. Therefore the considerations made in reference to structure 60 apply.

Figure 11:
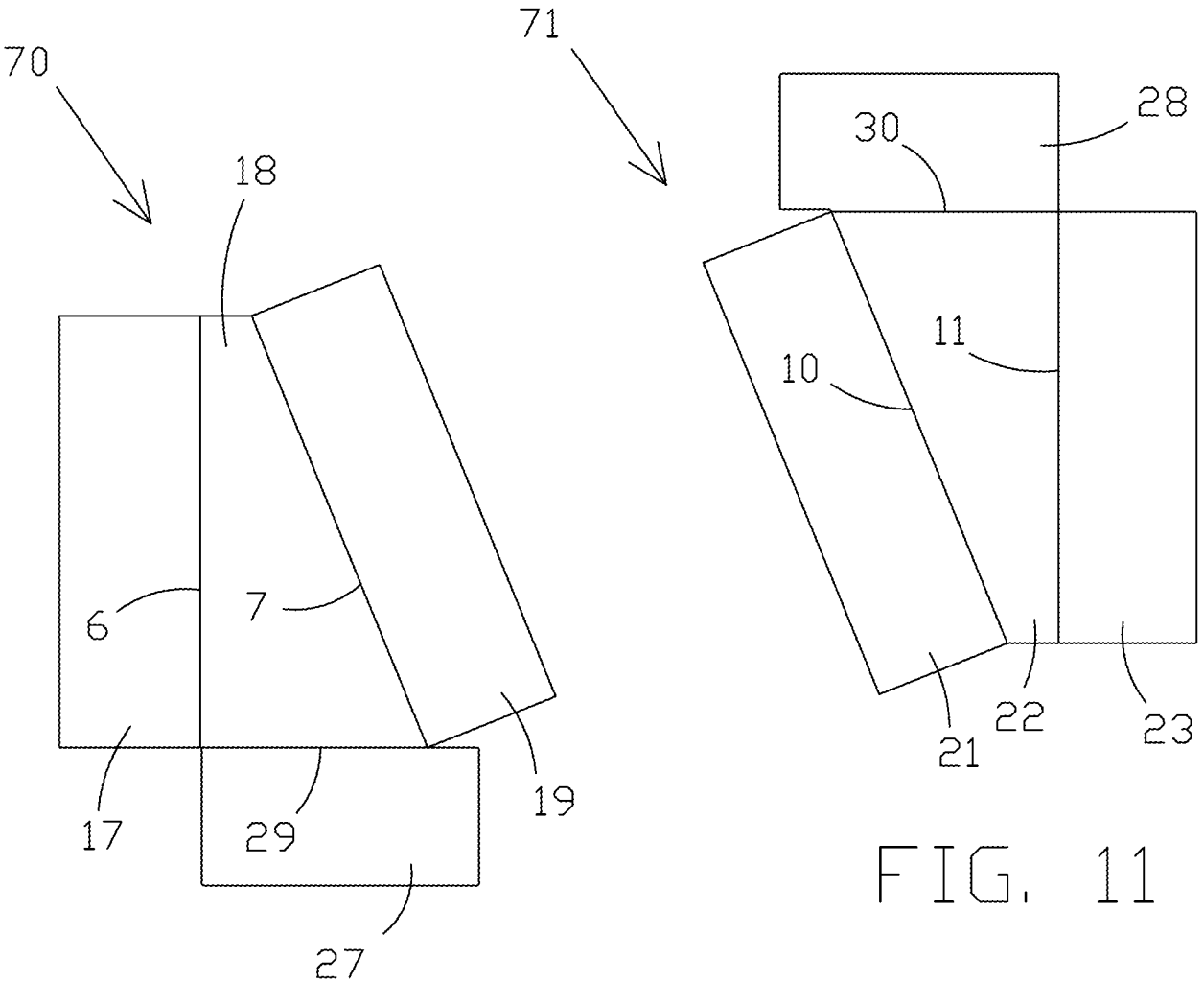
FIG. 11 shows a top plan view of a pair of cut and grooved cardboard sheets, according to the present invention, forming, as a whole, a third variant of the sheet in FIG. 1, which can be used in making a third variant of the structure in FIG. 4.

FIG. 11 shows a pair of substantially flat elements 70 and 71 foldable on themselves which, when considered as a whole, may be obtained from element 1 by removing the sections 14, 15, 16 and 20. Element 70 comprises the sections 17, 18, 19 and 27. Element 71 comprises the sections 21, 22, 23 and 28. Element 70 preferably is almost equal to element 71.

A structure may be obtained from the elements 70 and 71, which structure differs from structure 66 in that it does not have section 20. Namely, such a structure may be obtained by carrying out the following folding operations:

- a folding, preferably by 90°, of section 17 with respect to section 18 about grooving 6;
- a folding, preferably by 90°, of section 27 with respect to section 18 about grooving 29;
- a folding, preferably by 90°, of section 19 with respect to section 18 about grooving 7;

and

- a folding, preferably by 90°, of section 23 with respect to section 22 about grooving 11;
- a folding, preferably by 90°, of section 28 with respect to section 22 about grooving 30;
- a folding, preferably by 90°, of section 21 with respect to section 22 about grooving 10.

With reference to the plane in which the elements 70 and 71 in FIG. 11 lie, the sections 17, 19, 27 and 21, 23, 28 are folded on the same side with respect to the sections 18 and 22, respectively. In other words, by taking the face facing the observer in FIG. 11 as the upper face of the elements 70 and 71, the sections 17, 19, 27 and 21, 23, 28 are caused to rotate upwards, respectively.

At the end of the folding operations listed above, in order to obtain a structure which differs from structure 66 only in that it does not have section 20, it is sufficient to oppose the sections 19 and 21 against each other so that the sections 18 and 22 are coplanar and substantially consecutive to each other at the groovings 7 and 10.

Incidentally, the cuts 51, 52 and 53, 54 may equivalently be made in elements 70 and 71, respectively.

Figure 12:
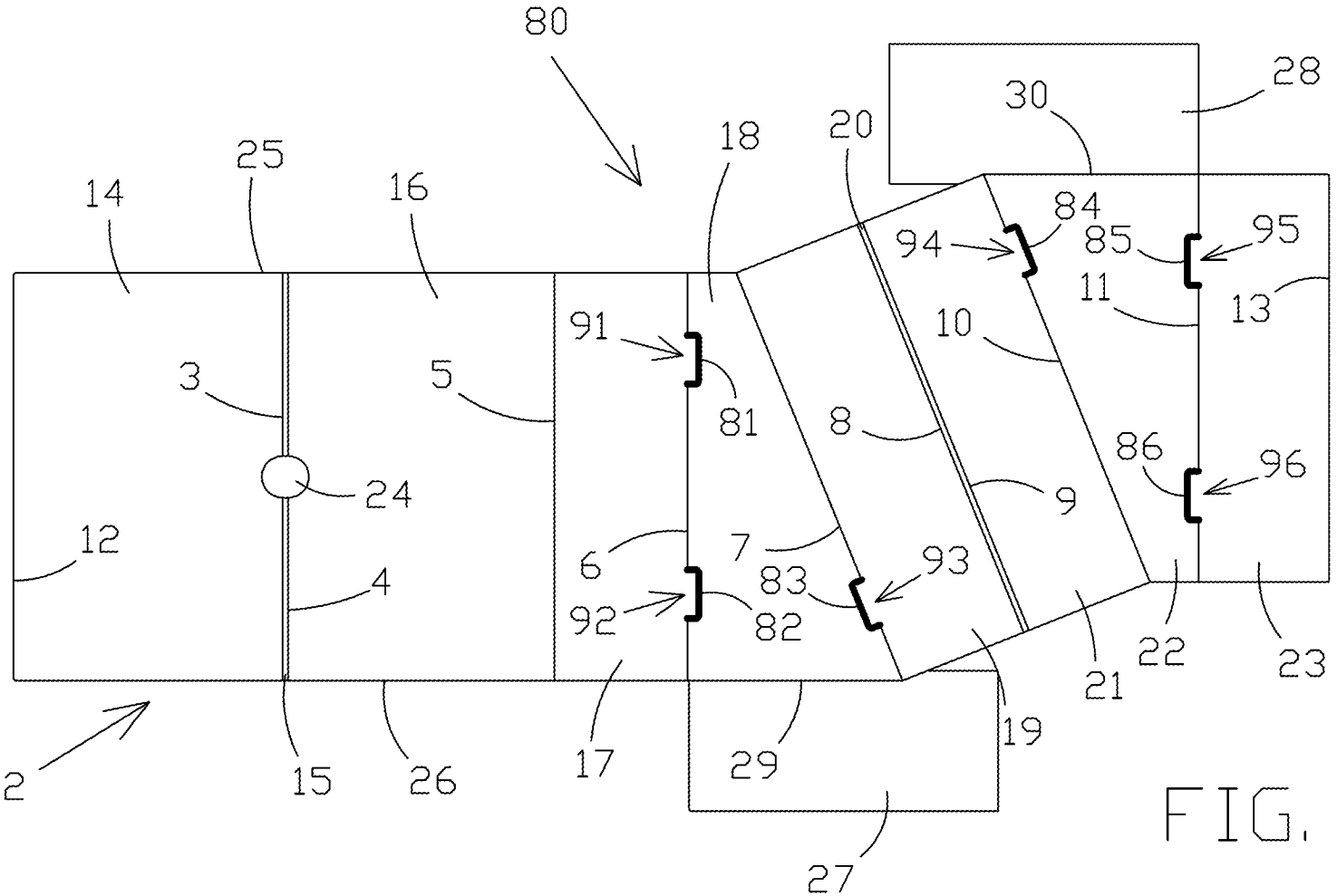
FIG. 12 shows a top plan view of a fourth variant of the sheet in FIG. 1, which can be used in making a fourth variant of the structure in FIG. 4.

FIG. 12 shows a substantially flat element 80 foldable on itself which differs from element 1 in that includes a plurality of through cuts 81, 82, 83, 84, 85 and 86 in place of respective stretches of the groovings 6, 7, 10 and 11. Namely:

- two cuts 81 and 82 preferably are in element 80 in place of two stretches of grooving 6. Although it is consecutive to section 18, section 17 is separate from the latter at the cuts 81 and 82. In other words, grooving 6 in element 80 is divided into three stretches (a middle one and two end ones opposite to each other) between which the cuts 81 and 82 are interposed. The latter preferably are made close to the two ends of grooving 6, respectively;
- one cut 83 preferably is in element 80 in place of one stretch of grooving 7. Although it is consecutive to section 19, section 18 is separate from the latter at cut 83. In other words, grooving 7 in element 80 is divided into two stretches which are opposite to each other and between which cut 83 is interposed. The latter preferably is made close to the end of grooving 7, also serving as end of grooving 29;
- one cut 84 preferably is in element 80 in place of one stretch of grooving 10. Although it is consecutive to section 22, section 21 is separate from the latter at cut 84. In other words, grooving 10 in element 80 is divided into two stretches which are opposite to each other and between which cut 84 is interposed. The latter preferably is made close to the end of grooving 10, also serving as end of grooving 30;
- two cuts 85 and 86 preferably are in element 80 in place of two stretches of grooving 11. Although it is consecutive to section 23, section 22 is separate from the latter at the cuts 85 and 86. In other words, grooving 11 in element 80 is divided into three stretches (a middle one and two end ones opposite to each other) between which the cuts 85 and 86 are interposed. The latter preferably are made close to the two ends of grooving 11, respectively.

Each of the cuts 81, 82, 83, 84, 85 and 86 preferably is at least partly unaligned with the stretches of grooving 6, 7, 10 and 11 between which it is interposed, and it encroaches on the preferably trapezoidal section to which it is adjacent. In particular, the cuts 81, 82 and 83 encroach on section 18, and the cuts 84, 85, 86 go into section 22. Due to such encroachments on element 80 with respect to element 1, albeit they remain substantially preferably trapezoidal, the sections 18 and 22 do not have small marginal portions 91, 92, 93, 94, 95 and 96 which can be defined as "nails" and became marginal portions of the sections 17, 19, 21 and 23, respectively. Namely:

- by encroaching on section 18, the cuts 81 and 82 delimit two nails 91 and 92, respectively, which correspond to marginal portions of section 18 in element 1, but they are marginal portions of section 17 in element 80;
- by encroaching on section 18, cut 83 delimits a nail 93 which corresponds to a marginal portion of section 18 in element 1, but it is a marginal portion of section 19 in element 80;
- by encroaching on section 22, cut 84 delimits a nail 94 which corresponds to a marginal portion of section 22 in element 1, but it is a marginal portion of section 21 in element 80;
- by encroaching on section 22, the cuts 85 and 86 delimit two nails 95 and 96, respectively, which correspond to marginal portions of section 22 in element 1, but they are marginal portions of section 23 in element 80.

As may be noted in FIG. 12, each cut 81, 82, 83, 84, 85 and 86 preferably is shaped as a crest of square wave. Each cut preferably comprises a first stretch parallel to the two stretches of grooving between which the cut is interposed, and a second and third stretch opposite to each other with respect to said first stretch and orthogonal to the two stretches of grooving between which the cut is interposed. The cuts 81, 82, 83, 84, 85 and 86 preferably are equal to one another.

Preferably, but not necessarily, element 80 differs from element 1 also for the different shape of the sections 27 and 28. Namely, rather than being constant for the whole length thereof (as in element 1), the width of the sections 27 and 28 is greater at the portion of the sections 27 and 28 which protrudes past the groovings 7 and 10, respectively. More preferably, rather than being adjacent to grooving 29 (as in element 1), the edge of section 27 including grooving 29, at the short stretch thereof protruding longitudinally past the end of grooving 7 is, proceeding from the aforesaid end, initially parallel to the edge of section 19 corresponding to the short side thereof consecutive to grooving 29, and then is parallel to the latter. Similarly, rather than being adjacent to grooving 30 (as in element 1), the edge of section 28 including grooving 30, at the short stretch thereof protruding longitudinally past the end of grooving 10 is, proceeding from the aforesaid end, initially parallel to the edge of section 21 corresponding to the short side thereof consecutive to grooving 30, and then is parallel to the latter. If the cuts 81, 82, 83, 84, 85 and 86 are shaped as a crest of square wave and are equal to one another, the difference between the width of each of the sections 27 and 28 at the portion thereof protruding past the groovings 7 and 10, respectively, and the width of each of the sections 27 and 28 at the portion thereof connected to the sections 18 and 22 (from the groovings 29 and 30), respectively, is equal to the height of the aforesaid crests of square wave, i.e. the distance between each stretch of the cuts 81, 82, 83, 84, 85 and 86 parallel to the groovings 6, 7, 10 and 11, respectively, and the latter. In light of what is said, the sections 27 and 28 preferably are equal to each other and are rotated by 180° with respect to each other.

By performing the same folding operations on element 80 performed to make structure 35 from element 1, a structure is obtained which constitutes a variant of structure 35 and differs from the latter due to the presence of the nails 91, 92, 93, 94, 95 and 96, which, being parallel to the sections 17,19, 21 and 23, respectively, protrude from the portions 18 and 22 of the base, preferably orthogonal to the latter, on the opposite side with respect to the partition walls 19 and 21.

If, as described above, rather than being constant for the whole length thereof, the width of the sections 27 and 28 is greater at the portion of the sections 27 and 28 which protrudes past the groovings 7 and 10, respectively, the structure which is obtained from element 80 differs from structure 35 also in that two portions of the side walls 27 and 28, respectively, protrude from the portions 18 and 22 of the base, preferably orthogonal to the latter, on the opposite side with respect to the partition walls 19 and 21 (i.e. on the same part as the nails 91, 92, 93, 94, 95). The portions of the side walls 27 and 28 protruding past the portions 18 and 22 of the base correspond to the portions of the sections 27 and 28, respectively, of element 80 which extend transversely past the groovings 29 and 30.

The nails 91, 92, 93, 94, 95 and 96 and, when present, the aforesaid protruding portions of the side walls 27 and 28, serve as spacer means of the portions 18 and 22 of the base from a plane on which the structure of the invention is possibly rested. When the latter is inserted into box 40, although they overlap base 41, the portions 18 and 22 of the base of the structure of the invention are therefore kept at a given distance from the base by the nails 91, 92, 93, 94, 95 and 96 and by the aforesaid protruding portions of the side walls 27 and 28. Thus, an air gap is created between base 41 and the portions 18 and 22 of the base.

When the structure of the invention is inserted into box 40 and accommodates a pair of shoes in the compartments 37 and 38, the nails 91, 92, 93, 94, 95 and 96 and, when present, the aforesaid protruding portions of the side walls 27 and 28, advantageously serve as buffers if, by way of example, box 40 is erroneously caused to fall on the ground. The structure which may be obtained from element 80 therefore provides an additional protection for the pair of shoes possibly accommodated therein, with respect to the protection provided by structure 35.

By way of example, there are only six cuts 81, 82, 83, 84, 85 and 86. For the purposes of the invention, element 80 could include only the cuts 81, 82, 85 and 86 for the creation of a gap between the base 41 of box 40 and the portions 18 and 22 of the base of the structure of the invention. Element 80 might therefore not have one or both the cuts 83 and 84 and/or one or both the portions of the sections 27 and 28 corresponding to the aforesaid protruding portions of the side walls 27 and 28.

Alternatively, for the purposes of the invention, element 80 could include only the cuts 81 and 86 and the portions of the sections 27 and 28 corresponding to the aforesaid protruding portions of the side walls 27 and 28. Element 80 might therefore not have one or both the cuts 82 and 85 and/or one or both the cuts 83 and 84.

Incidentally, if element 80 does not include the cuts 83 and 84, the cuts 51, 52, 53 and 54, and possibly also the cuts 57 and 58, may equivalently be made in element 80. Here, said cuts 51, 52, 53 and 54, and possibly also 57 and 58, are also found in the structure which may be obtained from element 80. Therefore the considerations made in reference to structure 60 apply.

Incidentally, the cuts 81, 82, 83, 84, 85 and 86, and possibly also the portions of the sections 27 and 28 corresponding to the aforesaid protruding portions of the side walls 27 and 28, may equivalently be in element 65. Here, the nails 91, 92, 93, 94, 95 and 96, and possibly also the aforesaid protruding portions of the side walls 27 and 28, are also found in structure 66.

Incidentally, the cuts 81, 82, 83, 84, 85 and 86, and possibly also the portions of the sections 27 and 28 corresponding to the aforesaid protruding portions of the side walls 27 and 28, may equivalently be in element 70 and 71, respectively. Here, the nails 91, 92, 93, 94, 95 and 96, and possibly also the aforesaid protruding portions of the side walls 27 and 28, are also found in structure which may be obtained from the elements 70 and 71.

Figure 13:
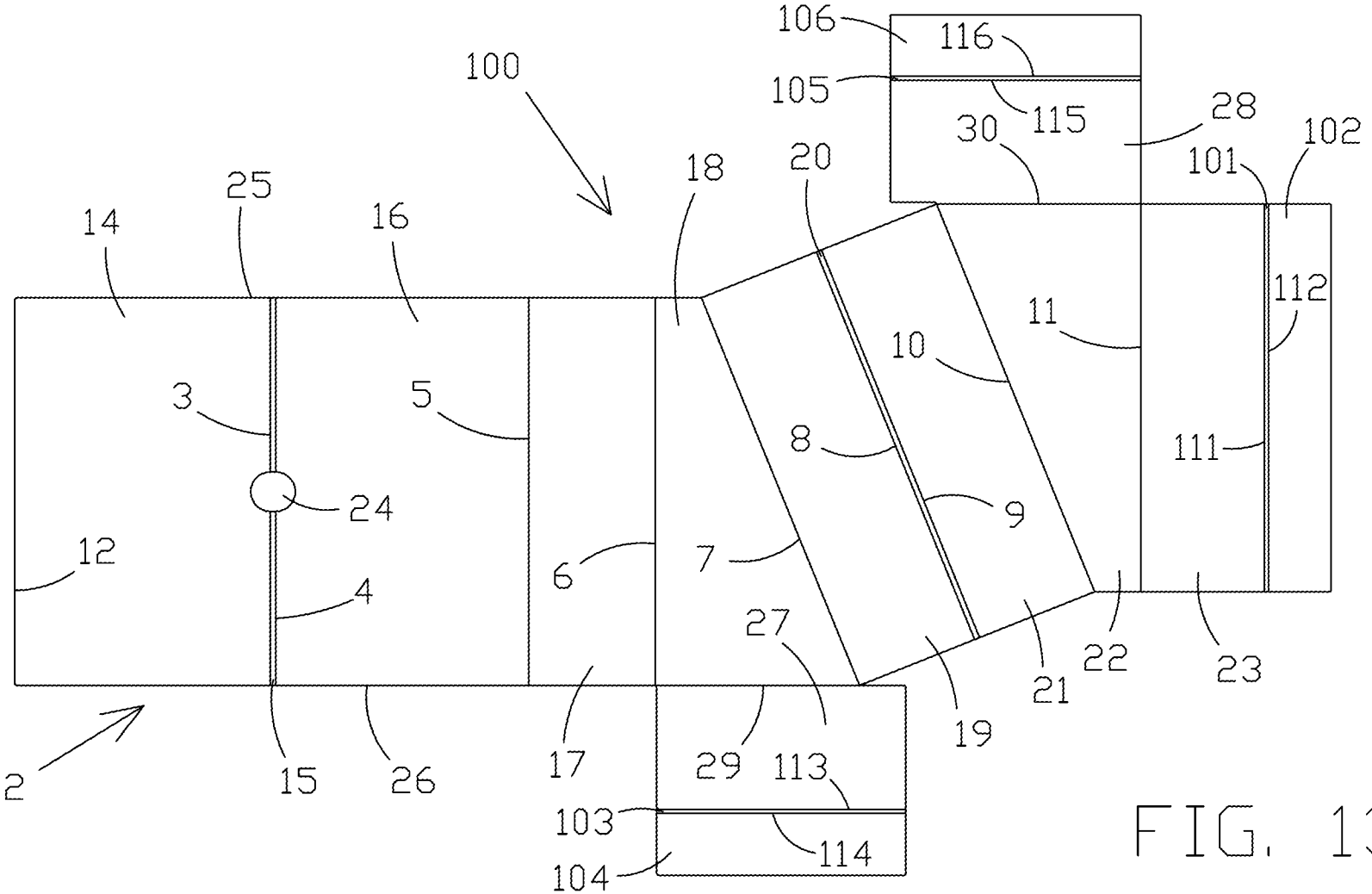
FIG. 13 shows a top plan view of a fifth variant of the sheet in FIG. 1, which can be used in making a fifth variant of the structure in FIG. 4.

FIG. 13 shows a substantially flat element 100 foldable on itself which differs from element 1 in that it includes six further sections 101, 102, 103, 104, 105 and 106, preferably rectangular sections, connected to one another and to the sections 23, 27 and 28 by means of six respective groovings 111, 112, 113, 114, 115 and 116. Namely:

- section 101, at an edge coincident with a long side thereof, is connected, by means of grooving 111, to section 23 at the edge of the latter, opposite to grooving 11;
- section 102, at an edge coincident with a long side thereof, is connected, by means of grooving 112, to section 101 at the edge of the latter, opposite to grooving 111;
- section 103, at an edge coincident with a long side thereof, is connected, by means of grooving 113, to section 27 at the edge of the latter, opposite to grooving 29;
- section 104, at an edge coincident with a long side thereof, is connected, by means of grooving 114, to section 103 at the edge of the latter, opposite to grooving 113;
- section 105, at an edge coincident with a long side thereof, is connected, by means of grooving 115, to section 28 at the edge of the latter, opposite to grooving 30;
- section 106, at an edge coincident with a long side thereof, is connected, by means of grooving 116, to section 105 at the edge of the latter, opposite to grooving 115.

The sections 101 and 102 preferably have the same width. More preferably, the sections 101 and 102 have the same width as section 23. The edges of the sections 101 and 102 corresponding to the short sides of the latter preferably are aligned with the edges, respectively, of section 23 corresponding to the short sides thereof. Section 102 has a length which preferably is less than the length of section 23, and more preferably is equal to about half the length of the latter. Section 101 has a much smaller length than the one of section 23. More preferably, section 101 has a length which is almost equal to twice the thickness of element 100.

According to one variant of element 100, rather than being connected to each other by section 101 and by the groovings 111 and 112, the sections 23 and 102 are mutually connected by a single grooving.

According to another variant of element 100, section 101 preferably is trapezoidal isosceles, with the smallest base at grooving 111 and the largest base (having a slightly greater length than the one of the smallest base) at grooving 112. According to this variant, the edges of section 101 corresponding to the oblique sides of the latter are consecutive, respectively, but not adjacent to the edges of section 23 corresponding to the short sides thereof.

The sections 103 and 104 preferably have the same length. More preferably, the sections 103 and 104 have the same length as section 27. The edges of the sections 103 and 104 corresponding to the short sides of the latter preferably are aligned with the edges, respectively, of section 27 corresponding to the short sides thereof. Section 104 has a width which preferably is less than the width of section 27, and more preferably is equal to about half the width of the latter. Section 103 has a much smaller width than the one of section 27. More preferably, section 103 has a width which is almost equal to twice the thickness of element 100.

According to one variant of element 100, rather than being connected to each other by section 103 and by the groovings 113 and 114, the sections 27 and 104 are mutually connected by a single grooving.

According to another variant of element 100, section 103 preferably is trapezoidal rectangular, with the smallest base at grooving 113, the largest base (having a slightly greater length than the one of the smallest base) at grooving 114 and the side orthogonal to both bases aligned with (i.e. adjacent to) the edge of section 27 corresponding to the short side of the latter adjacent to grooving 6. According to this variant, the edge of section 103 corresponding to the oblique side of the latter is consecutive, but not adjacent, to the edge of section 27 corresponding to a short side thereof (not adjacent to grooving 6). The sections 105 and 106 preferably have the same length. More preferably, the sections 105 and 106 have the same length as section 28. The edges of the sections 105 and 106 corresponding to the short sides of the latter preferably are aligned with the edges, respectively, of section 28 corresponding to the short sides thereof. Section 106 has a width which preferably is less than the width of section 28, and more preferably is equal to about half the width of the latter. Section 105 has a much smaller width than the one of section 28. More preferably, section 105 has a width which is almost equal to twice the thickness of element 100.

According to one variant of element 100, rather than being connected to each other by section 105 and by the groovings 115 and 116, the sections 28 and 106 are mutually connected by a single grooving.

According to another variant of element 100, section 105 preferably is trapezoidal rectangular, with the smallest base at grooving 115, the largest base (having a slightly greater length than the one of the smallest base) at grooving 116 and the side orthogonal to both bases aligned with (i.e. adjacent to) the edge of section 28 corresponding to the short side of the latter not adjacent to grooving 11. According to this variant, the edge of section 105 corresponding to the oblique side of the latter is consecutive, but not adjacent, to the edge of section 28 corresponding to a short side thereof (adjacent to grooving 11).

Figure 14:
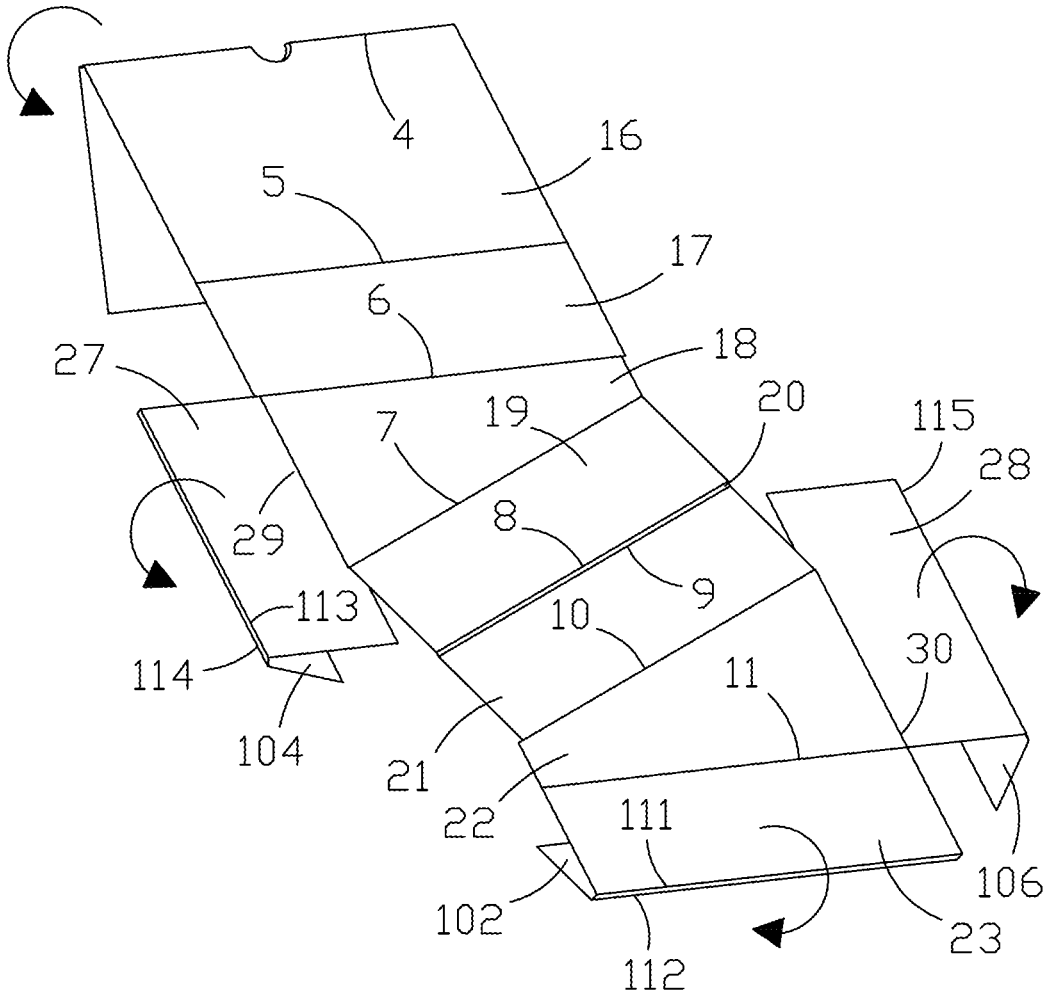
FIG. 14 shows a perspective diagrammatic view of a step of folding the sheet in FIG. 13 to obtain a fifth variant of the structure in FIG. 4.

FIG. 14 shows element 100 during:

- a folding by 180° of section 14 with respect to section 16 about groovings 3 and 4;
- a folding by 180° of section 102 with respect to section 23 about groovings 111 and 112;
- a folding by 180° of section 104 with respect to section 27 about groovings 113 and 114;
- a folding by 180° of section 106 with respect to section 28 about groovings 115 and 116.

Incidentally:

- similarly to what is said in reference to element 1, if the sections 14 and 16 in element 100 are connected to each other by a single grooving rather than by section 15 and by the groovings 3 and 4, section 14 is folded by 180° with respect to section 16 about said single grooving;
- if the sections 23 and 102 are connected to each other by a single grooving rather than by section 101 and by the groovings 111 and 112, section 102 is folded by 180° with respect to section 23 about said single grooving;
- if the sections 27 and 104 are connected to each other by a single grooving rather than by section 103 and by the groovings 113 and 114, section 104 is folded by 180° with respect to section 27 about said single grooving;
- if the sections 28 and 106 are connected to each other by a single grooving rather than by section 105 and by the groovings 115 and 116, section 106 is folded by 180° with respect to section 28 about said single grooving.

At the end of the aforesaid four folding operations:

- section 14 is opposed to section 16, preferably in contact therewith, and section 15 is arranged almost orthogonal to the sections 14 and 16;
- section 102 is opposed to section 23, preferably in contact therewith, and section 101 is arranged almost orthogonal to the sections 23 and 102;
- section 104 is opposed to section 27, preferably in contact therewith, and section 103 is arranged almost orthogonal to the sections 27 and 104;
- section 106 is opposed to section 28, preferably in contact therewith, and section 105 is arranged almost orthogonal to the sections 28 and 106.

An adhesive substance may be interposed between the faces of the opposed sections 14 and 16, 23 and 102, 27 and 104, 28 and 106. Said adhesive substance advantageously contributes to keeping the aforesaid sections folded by 180° with respect to one another, thus overcoming the possible elastic return of element 100.

Figure 15:
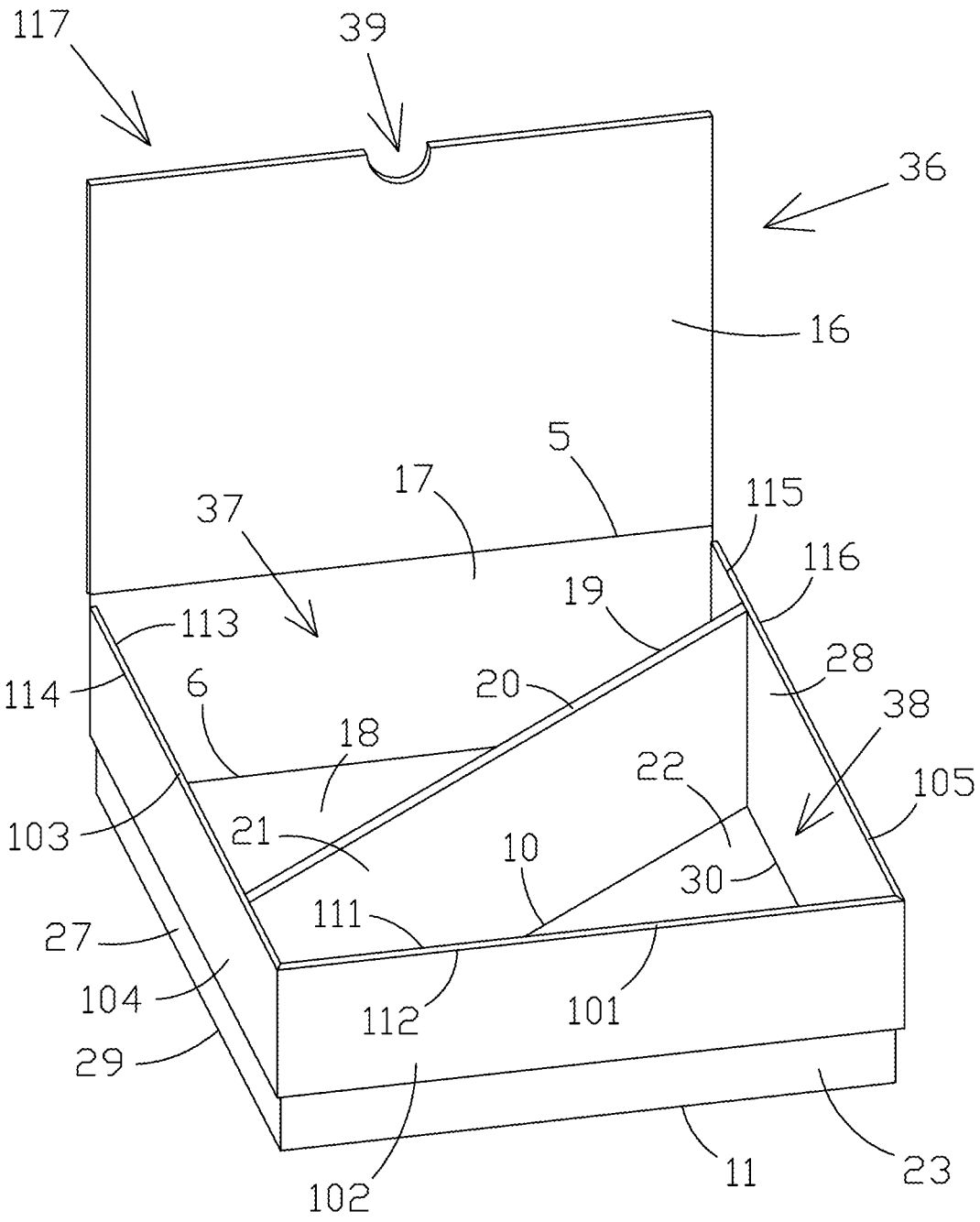
FIG. 15 shows a perspective diagrammatic view of a fifth variant of the structure in FIG. 4, obtained from the sheet in FIG. 13.

FIG. 15 shows a structure 117 obtained from element 100 after the execution on the latter of the four folding operations above (i.e. shown with reference to FIG. 14) and of further folding operations coincident with the ones performed on element 1 and shown with reference to FIG. 3. FIG. 15 shows element 100 with:

- sections 17 and 27 arranged both orthogonal to each other and orthogonal to section 18;
- sections 23 and 28 arranged both orthogonal to each other and orthogonal to section 22;
- sections 19 and 21 arranged orthogonal to sections 18 and 22, respectively;
- section 19 opposed to section 21, preferably in contact therewith, and section 20 arranged almost orthogonal to the sections 19 and 21;
- sections 18 and 22 preferably coplanar and substantially consecutive to each other at the folds originating from the groovings 7 and 10, respectively.

An adhesive substance may be interposed between the faces of the opposed sections 19 and 21. Said adhesive substance advantageously contributes to keeping the aforesaid sections 19 and 21 folded by 180° with respect to one another, thus overcoming the possible elastic return of element 100.

Structure 117 differs from structure 35 in that the side walls 23, 27 and 28 are provided with (side) wall linings coincident with the sections 102, 104 and 106, respectively. Said wall linings advantageously strengthen structure 117 with respect to structure 35. Additionally, the upper edges of the side walls 23, 27 and 28 correspond to the sections 101, 103 and 105, rather than coinciding with the free edges of the side walls opposite to the groovings 11, 29 and 30 (as in structure 35), respectively. Given that the sections 17, 23, 27 and 28 preferably are rectangular, given that the sections 17 and 23 preferably have the same length and given that the sections 27 and 28 have a width which preferably is equal to the length of section 17, the sections 101, 103 and 105 preferably are coplanar and parallel to the sections 18 and 22 of the base of structure 117. Thus, the aesthetic effect generated by the sections 101, 103 and 105 is valuable in partly delimiting the compartments 37 and 38 of structure 117.

Incidentally, as structure 35, structure 117 can be accommodated in box 40 so that the portions 18 and 22 overlap base 41, the side wall 17 is opposed to the side wall 45 and the side walls 23, 27 and 28 are opposed to the side walls 43, 42 and 44, respectively, by means of the wall linings 102, 14 and 106.

Advantageously, due to the presence of the sections 101, 103 and 105, respective air gaps are created between the side walls 23, 27 and 28 and the wall linings 102, 104 and 106. When structure 117 is inserted into box 40 and accommodates a pair of shoes in the compartments 37 and 38, the sections 101, 103 and 105 advantageously serve as buffers if, by way of example, box 40 is erroneously caused to fall on the ground. Structure 117 therefore provides an additional protection for the pair of shoes possibly accommodated therein, with respect to the protection provided by structure 35.

Incidentally, the cuts 51, 52, 53 and 54, and possibly also the cuts 57 and 58, may equivalently be made in element 100. Here, said cuts 51, 52, 53 and 54, and possibly also 57 and 58, are also found in structure 117. Therefore the considerations made in reference to structure 60 apply.

Incidentally, the sections 101, 102, 103, 104, 105 and 106 (and with them, the groovings 111, 112, 113, 114, 115 and 116) may equivalently be in element 65. Here, the wall linings 102, 104 and 106 and the upper edges 101, 103 and 105 also are in structure 66.

Incidentally, the sections 101, 102, 103, 104, 105 and 106 (and with them, the groovings 111, 112, 113, 114, 115 and 116) may equivalently be in the elements 70 and 71, respectively. Here, the wall linings 102, 104 and 106 and the upper edges 101, 103 and 105 also are in the structure that may be obtained from the elements 70 and 71.

Incidentally, the sections 101, 102, 103, 104, 105 and 106 (and with them, the groovings 111, 112, 113, 114, 115 and 116) may equivalently be in element 80. Here, the wall linings 102, 104 and 106 and the upper edges 101, 103 and 105 also are in the structure that may be obtained from element 80.

Figure 16:
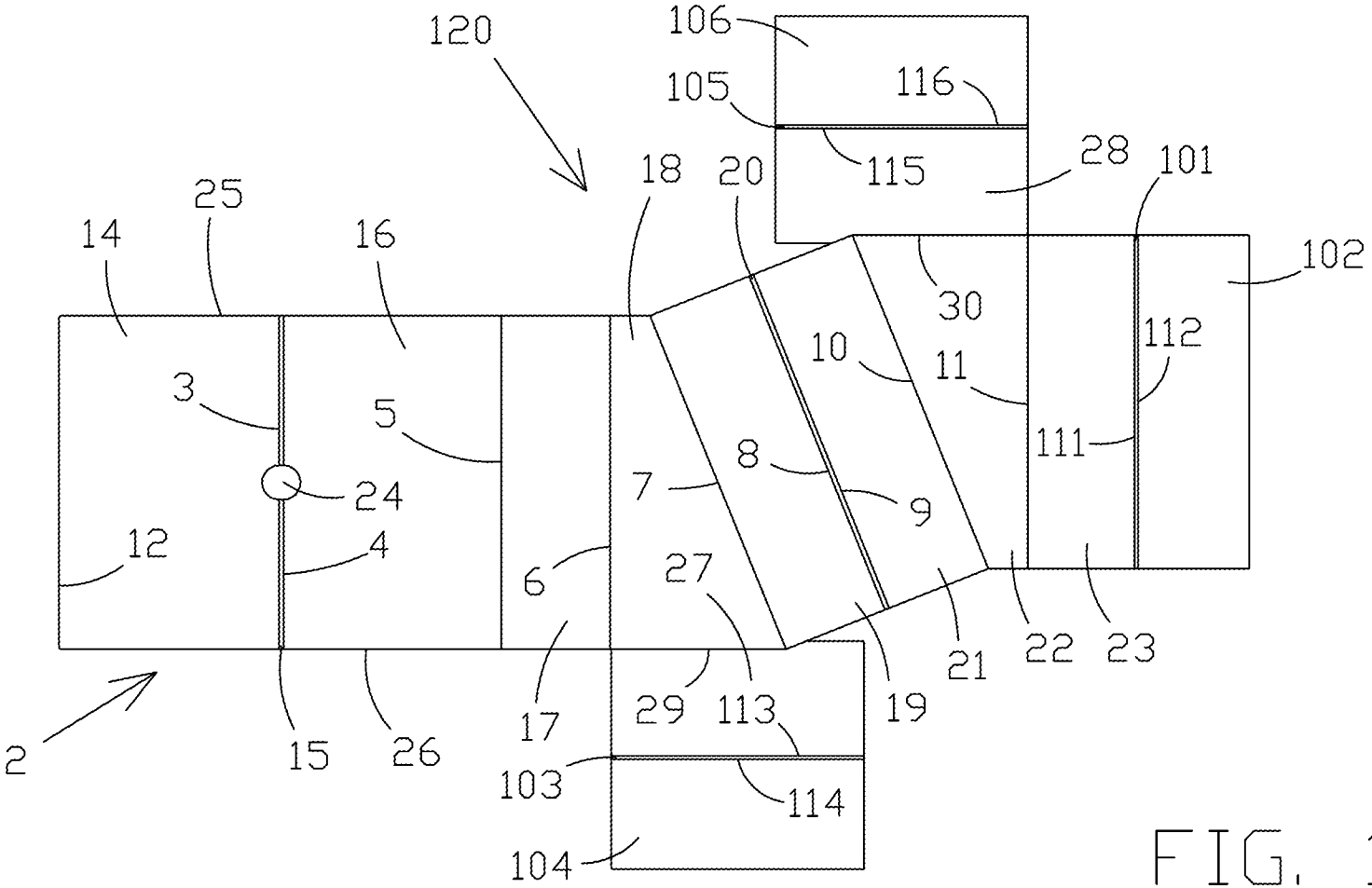
FIG. 16 shows a top plan view of a sixth variant of the sheet in FIG. 1, which can be used in making a sixth variant of the structure in FIG. 4.

FIG. 16 shows a substantially flat element 120 foldable on itself which differs from element 100 in that section 102 has a greater length than the one of section 23, section 104 has a greater width than the one of section 27, and section 106 has a greater width than the one of section 28. Due to this, by performing the same folding operations on element 120 performed to make structure 117 from element 100, a structure is obtained which constitutes a variant of structure 117 and differs from the latter due to the presence of portions of the wall linings 102, 104 and 106, which protrude from the portions 18 and 22 of the base, preferably orthogonal to the latter, on the opposite side with respect to the partition walls 19 and 21. Preferably, the sections 104 and 106 have the same width, equal to the length of section 102. In the structure obtained from sheet 120, the wall linings 102, 104 and 106 therefore protrude from the same extension as the portions 18 and 22 of the base.

Preferably, similarly to what is said with reference to element 80, but not necessarily, element 120 differs from element 100 also for the different shape of the sections 27 and 28. Namely, rather than being constant for the whole length thereof (like in element 1), the width of the sections 27 and 28 is greater at the portion of the sections 27 and 28 which protrudes past the groovings 7 and 10, respectively. More preferably, rather than being adjacent to grooving 29 (as in element 1), the edge of section 27 including grooving 29, at the short stretch thereof protruding longitudinally past the end of grooving 7 is, proceeding from the aforesaid end, initially parallel to the edge of section 19 corresponding to the short side thereof consecutive to grooving 29, and then is parallel to the latter. Similarly, rather than being adjacent to grooving 30 (as in element 1), the edge of section 28 including grooving 30, at the short stretch thereof protruding longitudinally past the end of grooving 10 is, proceeding from the aforesaid end, initially parallel to the edge of section 21 corresponding to the short side thereof consecutive to grooving 30, and then is parallel to the latter. If the sections 104 and 106 have the same width, equal to the length of section 102, the difference between the width of each of the sections 27 and 28 at the portion thereof protruding past the groovings 7 and 10, respectively, and the width of each of the sections 27 and 28 at the portion thereof connected to the sections 18 and 22 (from the groovings 29 and 30), respectively, is equal to the difference between the length of section 102 and the one of section 23, which is equal to the difference between the width of section 104 and the one of section 27, which is equal to the difference between the width of section 106 and the one of section 28. In light of what is said, the sections 27 and 28 preferably are equal to each other and are rotated by 180° with respect to each other.

If, as described above, rather than being constant for the whole length thereof, the width of the sections 27 and 28 is greater at the portion of the sections 27 and 28 which protrudes past the groovings 7 and 10, respectively, the structure which is obtained from element 120 differs from structure 117 also in that two portions of the side walls 27 and 28, respectively, protrude from the portions 18 and 22 of the base, preferably orthogonal to the latter, on the opposite side with respect to the partition walls 19 and 21 (i.e. on the same part as the wall linings 102, 104 and 106). The portions of the side walls 27 and 28 protruding past the portions 18 and 22 of the base correspond to the portions of the sections 27 and 28, respectively, of element 120 which extend transversely past the groovings 29 and 30.

As the nails 91, 92, 93, 94, 95 and 96 in the structure obtained from element 80, the protruding portions of the wall linings 102, 104 and 106 and, when present, the protruding portions of the side walls 27 and 28, serve as spacer means of the portions 18 and 22 of the base from a plane on which the structure of the invention is possibly rested. When the latter is inserted into box 40, although they overlap base 41, the portions 18 and 22 of the base of the structure of the invention are therefore kept at a given distance from the base by the protruding portions of the wall linings 102, 104 and 106 and by the protruding portions of the side walls 27 and 28. Thus, an air gap is created between base 41 and the portions 18 and 22 of the base.

When the structure of the invention is inserted into box 40 and accommodates a pair of shoes in the compartments 37 and 38, the protruding portions of the wall linings 102, 104 and 106 and, when present, the protruding portions of the side walls 27 and 28, advantageously serve as buffers if, by way of example, box 40 is erroneously caused to fall on the ground. As the structure which may be obtained from element 80, the structure which may be obtained from element 120 therefore provides an additional protection for the pair of shoes possibly accommodated therein, with respect to the protection provided by structure 35.

Incidentally, similarly to what is said with reference to structure 117, the structure which may be obtained from element 120 can be accommodated in box 40 so that the portions 18 and 22 overlap base 41, the side wall 17 is opposed to the side wall 45 and the side walls 23, 27 and 28 are opposed to the side walls 43, 42 and 44, respectively, by means of the wall linings 102, 14 and 106.

Incidentally, the cuts 51, 52, 53 and 54, and possibly also the cuts 57 and 58, may equivalently be made in element 120. Here, said cuts 51, 52, 53 and 54, and possibly also 57 and 58, also are in the structure which may be obtained from element 120. Therefore the considerations made in reference to structure 60 apply.

Incidentally, the sections 101, 102, 103, 104, 105 and 106 (and with them, the groovings 111, 112, 113, 114, 115 and 116) and possibly also the portions of the sections 27 and 28 corresponding to the aforesaid protruding portions of the side walls 27 and 28, may equivalently be in element 65.

Incidentally, the sections 101, 102, 103, 104, 105 and 106 (and with them, the groovings 111, 112, 113, 114, 115 and 116) and possibly also the portions of the sections 27 and 28 corresponding to the aforesaid protruding portions of the side walls 27 and 28, may equivalently be in the elements 70 and 71, respectively.

On the basis of the description provided for a preferred example embodiment, it is obvious that certain changes can be made by those skilled in the art without departing from the scope of the invention as defined by the following claims.

The invention claimed is:

1. A partition and cover structure that can be accommodated in a shoebox and can be made from one or more substantially flat elements foldable on themselves, said structure comprising:

a base divided into a first and a second portion;

a first partition wall including a mutually opposite first and second edge, said first partition wall being connected, by means of a fold, at at least one stretch of its first edge, to at least one stretch of a first edge of said first portion of said base;

a second partition wall including a mutually opposite first and second edge, said second partition wall being connected, by means of a fold, at at least one stretch of its first edge, to at least one stretch of a first edge of said second portion of said base, said partition walls being opposable to each other in such a manner whereby when said partition walls are opposed to each other, said first and second portion of said base substantially are consecutive to each other at the respective first edge thereof;

a first, a second, a third and a fourth side wall, two-by-two mutually opposed with respect to said base, at least one of said side walls being connected, by means of at least one fold, to said first or second portion of said base, each of said side walls being connected, by means of at least one fold, to said first or second portion of said base or to another of said side walls wherein:

said first edge of said first partition wall is separate from said first edge of said first portion of said base at two mutually opposite end stretches thereof;

said first edge of said second partition wall is separate from said first edge of said second portion of said base at two mutually opposite end stretches thereof;

said first partition wall comprises a first cut which extends from said first edge to said second edge of said first partition wall, from an end of one of said two end stretches of said first edge of said first partition wall; and said second partition wall comprises a second cut which extends from said first edge to said second edge of said second partition wall, from an end of the end stretch of said first edge of said second partition wall not opposed to the end stretch from the end of which said first cut departs, when said first and second portion of said base substantially are consecutive to each other at the respective first edge thereof.

2. A structure according to claim 1, wherein said second partition wall is connected, by means of at least one fold, to said second edge of said first partition wall at its second edge.

3. A structure according to claim 2, wherein said first and second portion of said base are shaped in such a manner whereby when said first and second portion of said base substantially are consecutive to each other at the respective first edge thereof, said base substantially is square- or rectangular-shaped, said first edge of said first and second portion of said base being tilted with respect to each of the four edges of said base corresponding to the four sides of said square or rectangular shape.

4. A structure according to claim 2, wherein said portions of said base, said partition walls and said side walls are at least partly covered by a layer including at least a material selected in the group comprising fabric, non-woven fabric, paint and polymeric materials.

5. A structure according to claim 1, wherein said first and second portion of said base are shaped in such a manner whereby when said first and second portion of said base substantially are consecutive to each other at the respective first edge thereof, said base substantially is square- or rectangular-shaped, said first edge of said first and second portion of said base being tilted with respect to each of the four edges of said base corresponding to the four sides of said square or rectangular shape.

6. A structure according to claim 1, wherein said portions of said base, said partition walls and said side walls are at least partly covered by a layer including at least a material selected in the group comprising fabric, non-woven fabric, paint and polymeric materials.

7. A structure according to claim 1, wherein:

said first side wall is connected, by means of a fold, to said first portion of said base at a second edge thereof opposite to said first edge of said first portion of said base;

said second side wall is connected, by means of a fold, to said second portion of said base at a second edge thereof opposite to said first edge of said second portion of said base;

said third side wall is connected, by means of a fold, to said first or second portion of said base at a third edge thereof interposed between said first and second edge of said first or second portion of said base;

said fourth side wall is connected, by means of a fold, to said first or second portion of said base at a further edge thereof interposed between said first and second edge of said first or second portion of said base.

8. A structure according to claim 7, wherein:

said first side wall is separate from said second edge of said first portion of said base at at least one stretch thereof shaped in such a manner whereby a portion of said first side wall protrudes from said first portion of said base on the opposite side of said first partition wall;

said second side wall is separate from said second edge of said second portion of said base at at least one stretch thereof shaped in such a manner whereby a portion of said second side wall protrudes from said second portion of said base on the opposite side of said second partition wall.

9. A structure according to claim 7, further comprising:

a first supporting wall that can be opposed to said second side wall and connected to the latter by means of at least one fold;

a second supporting wall that can be opposed to said third side wall and connected to the latter by means of at least one fold;

a third supporting wall that can be opposed to said fourth side wall and connected to the latter by means of at least one fold.

10. A structure according to claim 9, wherein:

said first supporting wall has such an extension whereby when said first supporting wall is opposed to said second side wall, a portion of said first supporting wall protrudes from said second portion of said base on the side opposite to said second partition wall;

said second supporting wall has such an extension whereby when said second supporting wall is opposed to said third side wall, a portion of said second supporting wall protrudes from said first or second portion of said base on the side opposite to said first and second partition wall;

said third supporting wall has such an extension whereby when said third supporting wall is opposed to said fourth side wall, a portion of said third supporting wall protrudes from said first or second portion of said base on the side opposite to said first and second partition wall.

11. A container comprising:

a shoebox including:

a square or rectangular base;

four side walls transversely connected to said base at respective edges thereof and delimiting, together with said base, a seat in which a pair of shoes can be accommodated;

said container being further comprising:

a structure according to claim 1, accommodated in said seat, said partition walls of said structure being mutually opposed, said first and second portion of said base of said structure being substantially consecutive to each other at the respective first edge thereof, said first and second portion of said base of said structure being shaped in such a manner whereby said base of said structure substantially is square- or rectangular-shaped and substantially has the same extension as the base of said box, said first and second portion of said base of said structure overlapping said base of said box, said side walls of said structure being opposed, respectively, to said side walls of said box.

12. A substantially flat element comprising a plurality of grooves about which said element is foldable on itself, said element comprising:

a first section;

a second section which is trapezoidal-rectangular in shape, connected to said first section by a first grooving made at an edge of said second section corresponding to the side of said trapezoidal shape arranged orthogonal to the largest base and to the smallest base thereof;

a third section;

a fourth section which is trapezoidal-rectangular in shape, connected to said third section by a second grooving made at an edge of said fourth section corresponding to the side of said trapezoidal shape arranged orthogonal to the largest base and to the smallest base thereof;

a fifth and a sixth section connected to each other by at least a third grooving, said fifth section also being connected to said second section by a fourth grooving opposite to said third grooving and made at an edge of said second section opposite to said first grooving, said sixth section also being connected to said fourth section by a fifth grooving opposite to said third grooving and made at an edge of said fourth section opposite to said second grooving, a seventh section connected to said second section by a sixth grooving made at an edge of said second section interposed between said first and fourth grooving, an eighth section connected to said fourth section by a seventh grooving made at an edge of said fourth section interposed between said second and fifth grooving wherein:

said fifth section is separate from said second section at two mutually opposite end stretches of the edge of said second section opposite to said first grooving;

said sixth section is separate from said fourth section at two mutually opposite end stretches of the edge of said fourth section opposite to said second grooving;

said fifth section comprises a first cut which extends from the edge of said second section opposite to said first grooving, from an end of one of said two end stretches of the edge of said second section, to said third grooving;

said sixth section comprises a second cut which extends from the edge of said fourth section opposite to said second grooving, from an end of the end stretch of the edge of said fourth section, further from said first cut, to said third grooving.

* * * * *